United States Patent [19]

Faiks et al.

[11] Patent Number: 5,026,117

[45] Date of Patent: Jun. 25, 1991

[54] CONTROLLER FOR SEATING AND THE LIKE

[75] Inventors: Frederick S. Faiks, Greenville; Craig M. Anderson, Kentwood; Daniel R. Bischoff, Grand Rapids, all of Mich.

[73] Assignee: Steelcase Inc., Mich.

[21] Appl. No.: 380,782

[22] Filed: Jul. 18, 1989

Related U.S. Application Data

[63] Continuation of Ser. No. 317,036, Feb. 28, 1989, abandoned, which is a continuation of Ser. No. 251,057, Sep. 26, 1988, abandoned, which is a continuation of Ser. No. 119,385, Nov. 10, 1987, abandoned.

[51] Int. Cl.[5] ..... A47C 3/00

[52] U.S. Cl. ..... 297/304; 267/131; 297/301

[58] Field of Search ..... 297/285, 300, 301, 304, 297/284; 267/131, 175, 177, 179; 248/560, 561, 563, 566, 567, 575, 578, 574, 596, 597

[56] References Cited

U.S. PATENT DOCUMENTS

| | | | |
|---|---|---|---|
| 217,584 | 7/1879 | Chichester . | |
| 240,888 | 5/1881 | Chichester . | |
| 244,733 | 7/1881 | Bliss et al. . | |
| 299,846 | 6/1884 | Parry . | |
| 316,127 | 4/1885 | Demand . | |
| 354,183 | 12/1886 | Davis . | |
| 555,029 | 2/1896 | Watkins et al. . | |
| 622,073 | 3/1899 | Quinlan . | |
| 928,051 | 7/1909 | Higgins | 297/286 |
| 981,939 | 1/1911 | Persons . | |
| 1,178,488 | 4/1916 | Bolens . | |
| 1,247,625 | 11/1917 | Bolens . | |
| 1,299,214 | 6/1917 | Bolens . | |
| 1,678,668 | 7/1928 | Collier . | |
| 1,986,105 | 4/1932 | Foote . | |
| 2,087,253 | 7/1937 | Herold . | |

(List continued on next page.)

FOREIGN PATENT DOCUMENTS

| | | | |
|---|---|---|---|
| 282928 | 12/1965 | Australia . | |
| 487244 | 10/1952 | Canada . | |
| 1530754 | 6/1969 | Fed. Rep. of Germany . | |
| 2048460 | 5/1971 | Fed. Rep. of Germany . | |
| 432243 | 3/1948 | Italy . | |
| 54-138230 | 9/1979 | Japan . | |
| 340976 | 10/1959 | Switzerland | 297/304 |
| 674251 | 6/1952 | United Kingdom . | |
| 811283 | 4/1959 | United Kingdom . | |
| 840946 | 7/1960 | United Kingdom | 267/131 |
| 1165135 | 9/1969 | United Kingdom | 297/285 |
| 1288773 | 9/1972 | United Kingdom . | |

*Primary Examiner*—Peter R. Brown

*Attorney, Agent, or Firm*—Price, Heneveld, Cooper, DeWitt & Litton

[57] ABSTRACT

A controller is provided for seating, and the like, such as chairs of the type that have a stationary base or support, and a back which tilts about a generally horizontal axis with respect to the support. The controller includes an adjustable tension device, and a shared-load arrangement, which readily adapt the chair for different users and various applications. The adjustable tension device comprises a spring, having one end operably connected with a support, and the other end operably engaging the back at selected locations spaced apart from the tilt axis, such that rearward tilting of the chair back deflects the spring, and thereby generates a torque or back tension which resists further tilting. A shifter moves the other end of the spring between the selected back locations to vary the lever arm at which the spring acts, and thereby adjusts back tension. The shared-load arrangement comprises second and third springs, which are positioned on opposite sides of the first spring, and are operably connected between the support and the back. The second and third springs are pretensed to generate an initial torque which biases the back into a normally, fully upright position. The three controller springs combine to share the load applied to the back, with the second and third springs providing an initial, minimum back tension, and the first spring providing an additional, variable back tension.

48 Claims, 10 Drawing Sheets

U.S. PATENT DOCUMENTS

| | | | |
|---|---|---|---|
| 2,403,425 | 7/1946 | Bolens . | |
| 2,619,153 | 11/1952 | Van Osselen . | |
| 2,729,273 | 1/1956 | Hamilton et al. . | |
| 2,760,553 | 8/1956 | Lie . | |
| 2,778,409 | 1/1957 | Soderberg . | |
| 2,784,767 | 3/1957 | Soderberg . | |
| 2,818,911 | 1/1958 | Syak . | |
| 2,845,991 | 8/1958 | Soderberg . | |
| 2,877,825 | 3/1959 | Olson . | |
| 2,971,569 | 2/1961 | Parrott et al. . | |
| 3,031,164 | 4/1962 | Schopf | 248/373 |
| 3,135,549 | 6/1964 | Larsson | 297/303 |
| 3,203,661 | 8/1965 | Brendel | 248/399 |
| 3,301,520 | 1/1967 | Barth et al. | 248/399 |
| 3,339,906 | 9/1967 | Persson | 267/1 |
| 3,437,304 | 4/1969 | Decker | 248/399 |
| 3,594,040 | 7/1971 | Monroe | 297/307 |
| 3,650,498 | 3/1972 | Deak | 248/18 |
| 3,659,819 | 5/1972 | Wolters | 284/373 |
| 3,669,399 | 6/1972 | Wager | 248/373 |
| 3,685,780 | 8/1972 | Stannebein | 248/399 |
| 3,693,925 | 9/1972 | Weinstein | 248/378 |
| 3,756,552 | 9/1973 | Wilhelms et al. | 248/399 |
| 3,806,075 | 4/1974 | Sturhan | 248/399 |
| 3,897,036 | 7/1975 | Nystrom | 248/399 |
| 4,013,257 | 3/1977 | Paquette | 248/379 |
| 4,018,415 | 4/1977 | Wolters | 297/304 |
| 4,019,777 | 4/1977 | Hayashi | 297/284 |
| 4,077,596 | 3/1978 | Pinaire et al. | 248/379 |
| 4,103,858 | 8/1978 | Swenson | 248/399 |
| 4,575,150 | 3/1986 | Smith | 297/300 |
| 4,595,236 | 6/1986 | Rizzoli | 297/316 |
| 4,671,569 | 6/1987 | Kazaoka et al. | 297/284 |

FIG. 3
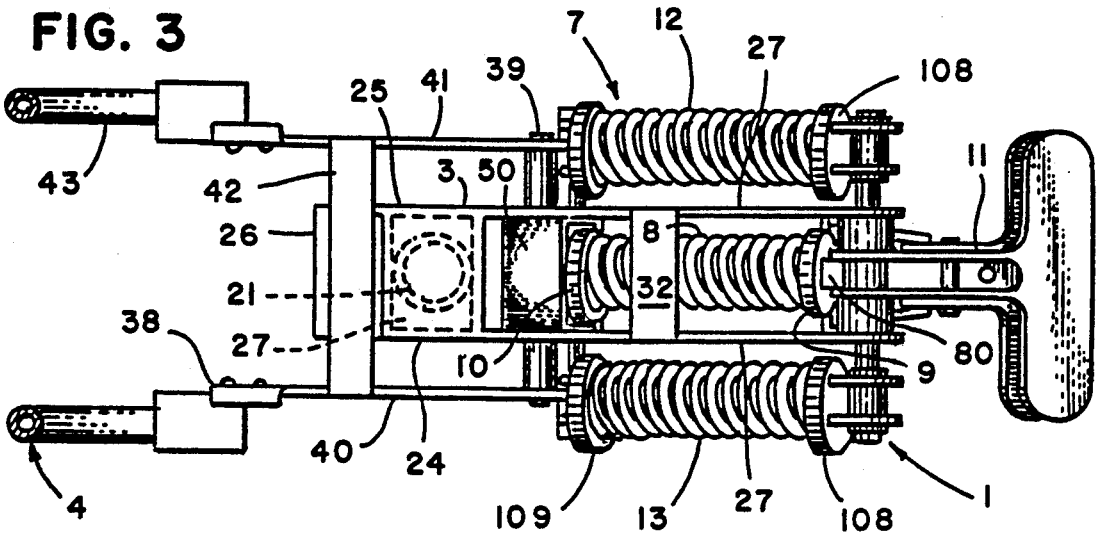
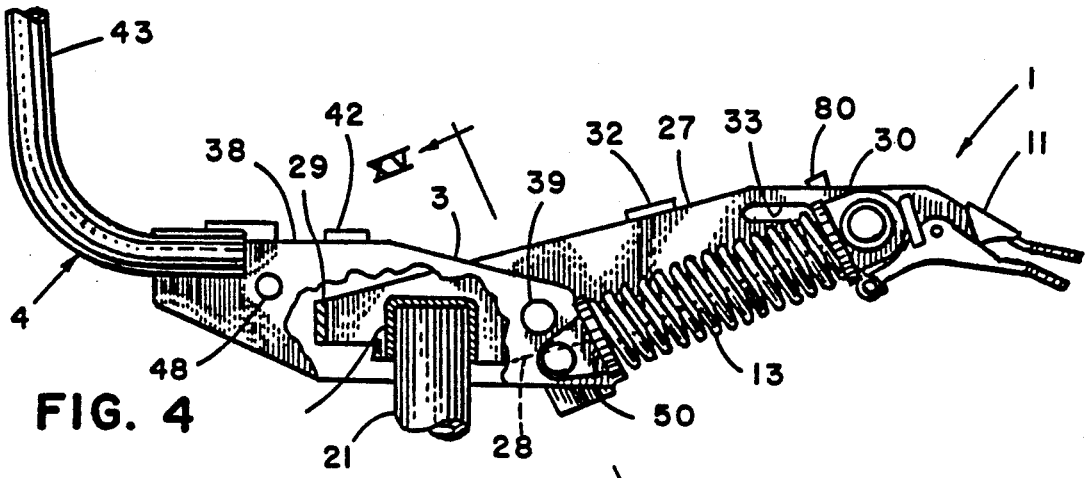
FIG. 4
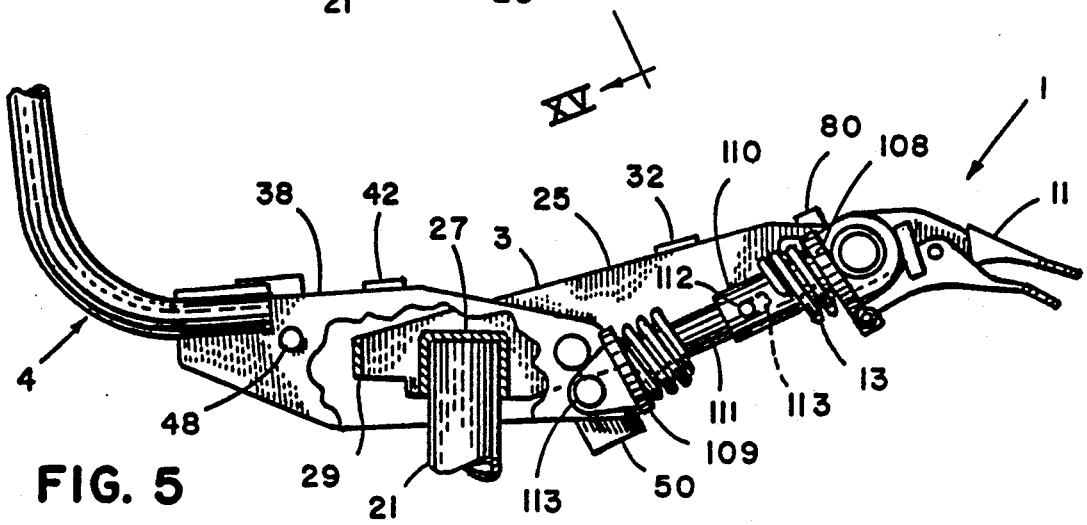
FIG. 5

FIG. 11
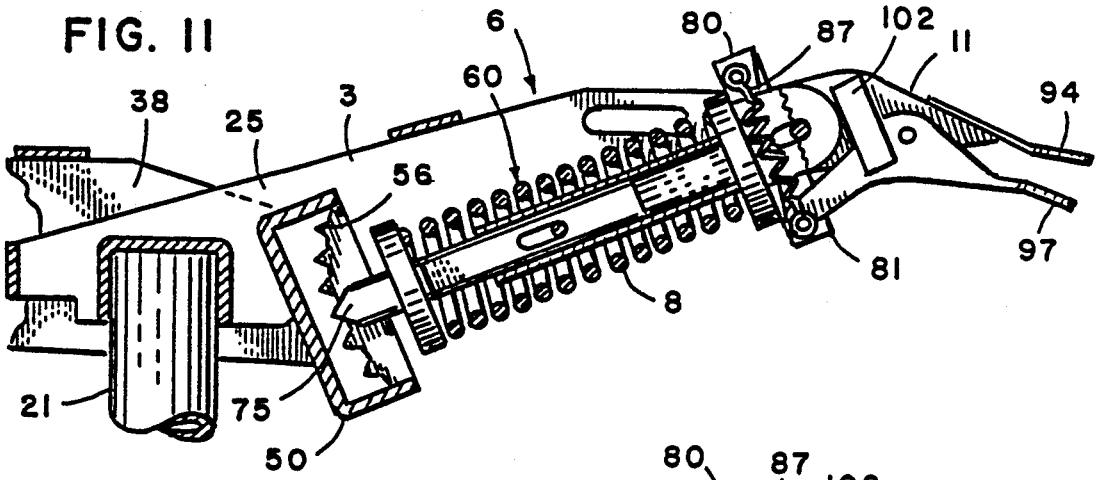
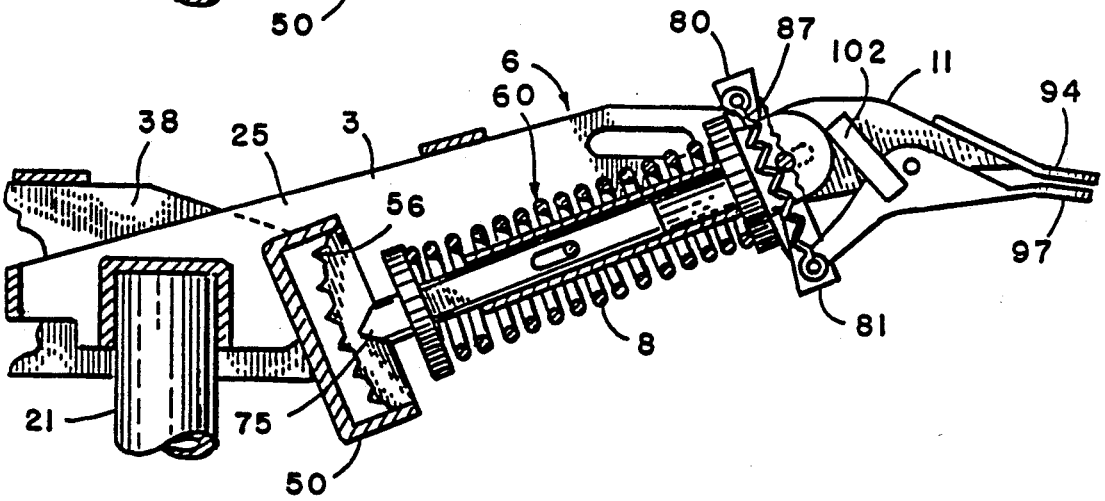
FIG. 12
FIG. 13
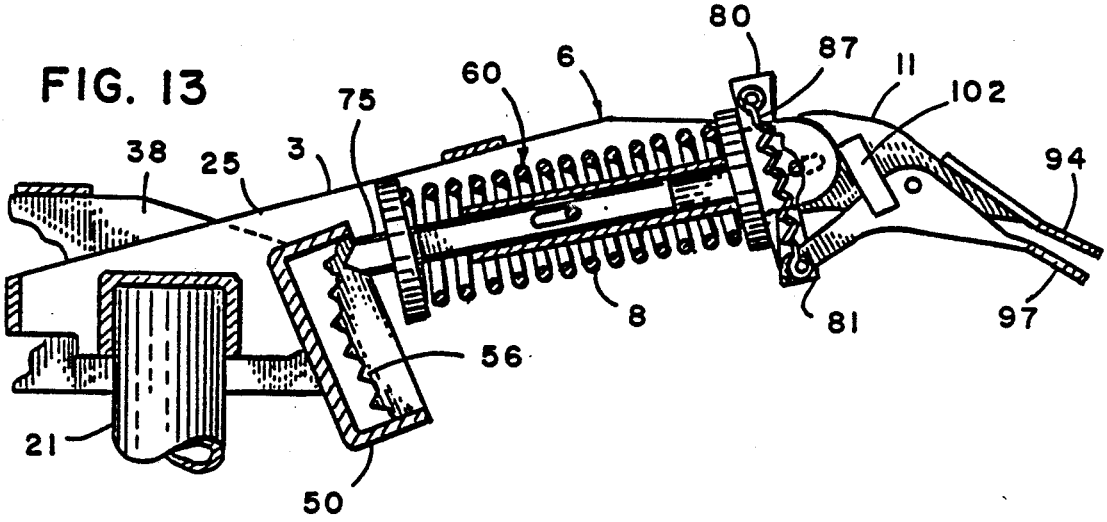

FIG. 16
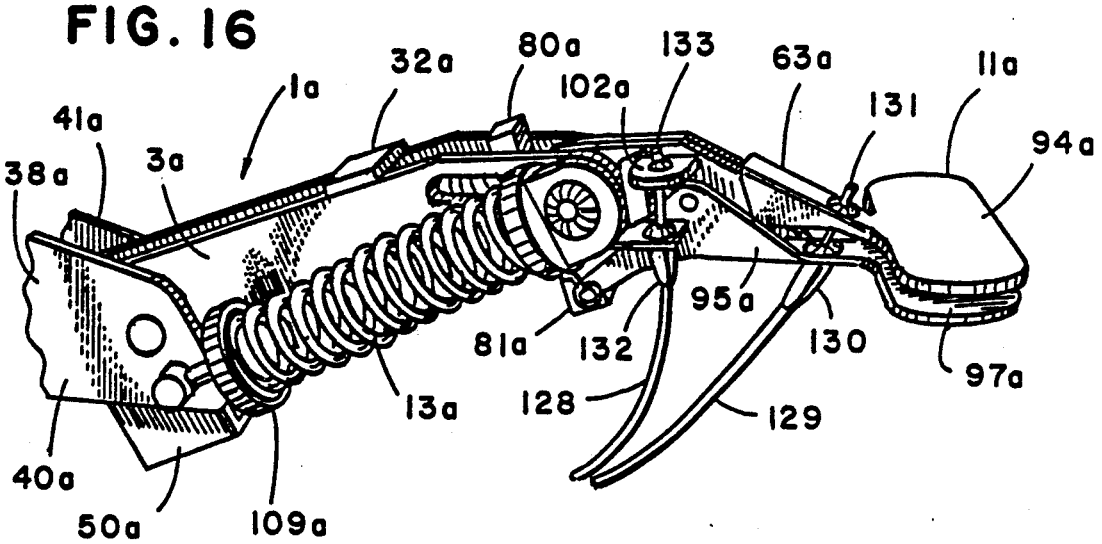
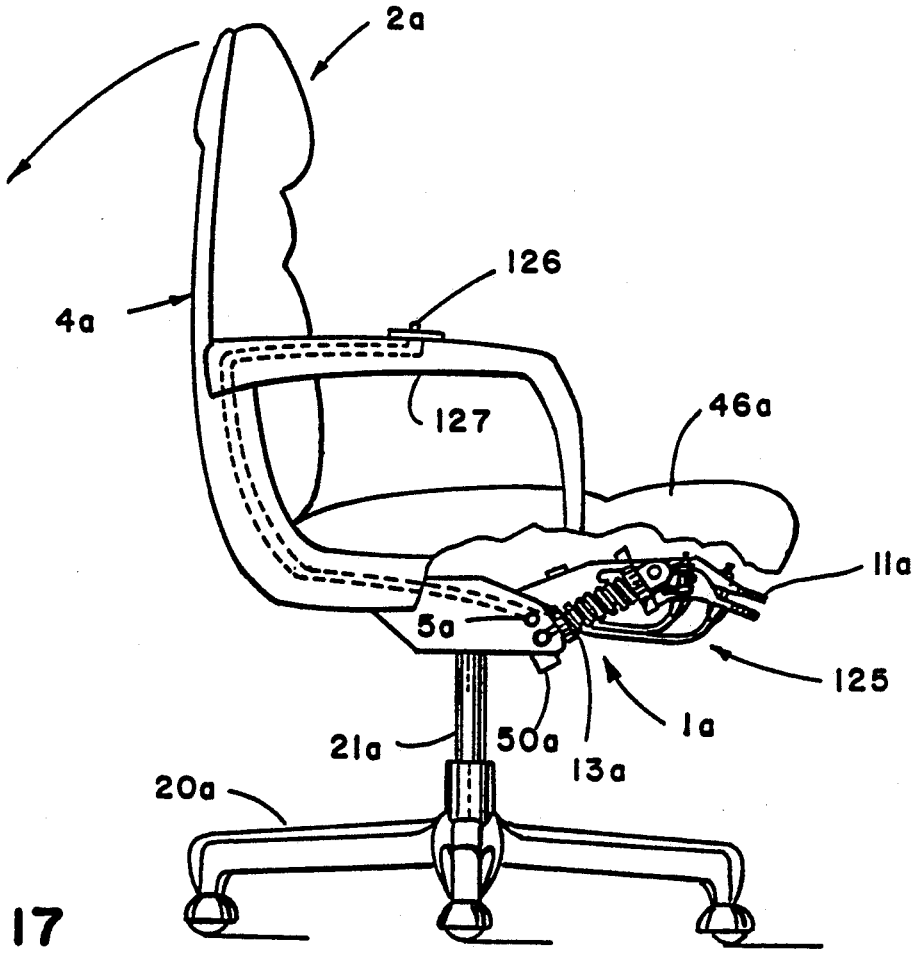
FIG. 17

CONTROLLER FOR SEATING AND THE LIKE

This is a continuation of co-pending application Ser. No. 317,036, filed on Feb. 28, 1989 now abandoned. which is a continuation of co-pending application Ser. No. 251,057 filed on Sept. 26, 1989 now abandoned. which is a continuation of co-pending application Ser. No. 119,385, filed on Nov. 10, 1987, now abandoned.

BACKGROUND OF THE INVENTION

The present invention relates to controllers for seating, and the like.

Articulated seating, such as tilt back chairs, swivel chairs, and other furniture articles of the type having at least two, mutually adjustable portions, are used extensively in office environments. The mutually adjustable portions of the seating are normally interconnected by a control or controller, having springs which bias the seating into a normal, fully upright position. The controller typically includes some type of adjustment device to vary the biasing forces which resist movement of the adjustable portions of the seating from their normal position.

In the specific example of tilt back chairs, the controller may have an adjustment device to regulate the "pretension" on the back, and/or the "tilt rate" of the back, as explained hereinafter. Controller "pretension" refers to the application of an initial force or torque to the back of the chair, which retains the chair back in a normally, fully upright position. The user must apply a positive force to the chair back, which force is sufficient to overcome the controller pretension, before the chair back will tilt rearwardly. Controller "tilt rate" refers to the torque which resists rearward tilting, once the chair back begins to tilt. The controller tilt rate normally varies as a function of the angle of inclination of the back, and depends upon the type of springs used, the location of the tilt axis, and other similar factors.

Because users have widely different physical characteristics, including weight, shape, and strength, the ultimate or most comfortable controller pretension and tilt rate varies from one individual to another. FIG. 14 is a graph which illustrates the torque developed by a chair controller to resist tilting of the back (which in a static state is equal to the torque applied to the back by the user), as a function of the back's tilt angle or rotational displacement from the normally upright position of the chair back. The graph line identified by the letter "L" is an empirically derived function, and represents the controller pretension and the controller tilt rate which is generally preferred by a majority of users that weigh somewhat less than the average body weight of all chair users. The graph line identified by the letter "H" is also an empirically derived function, and represents the controller pretension and the controller tilt rate which is generally preferred by a majority of users that weigh somewhat more than the average body weight of all chair users. Individuals that have a body weight which is more than that associated with graph line "L," but less than that associated with graph line "H," will normally prefer a controller pretension and a controller tilt rate that is somewhere inbetween graph lines "L" and "H," as identified by the lines I*a*, I*b*, I*c* and I*d*.

A type of seating known as "task seating" is becoming increasingly popular for use at computer terminals, and other similar work stations. Such work stations typically have more than one work surface or area between which the worker traverses, and may also be shared by several workers. Hence, a task chair cannot only be used at different areas of a work station, but may also be used by several different individuals on a regular basis, and therefore must be particularly adaptable for all types of applications, work surface heights, and tasks. The ability to adjust the controller pretension and controller tilt rate in all types of articulated seating is clearly a preferred feature. However, in task seating, such adjustment capabilities are now being considered nearly essential to the marketability of the chair. It is particularly important that those adjustments for controller pretension and/or tilt rate be capable of being made quickly and easily by the workers themselves. Preferably, the adjustments can be made by the user while actually sitting on the seating, so that the back tension can be quickly tested and easily readjusted, if necessary, to attain maximum comfort. Furthermore, it is important that the tilt function be adjustable throughout a broad range, so as to be able to adapt the chair into a comfortable configuration for a wide variety of different persons and tasks.

SUMMARY OF THE INVENTION

One aspect of the present invention is to provide an efficient and effective controller for seating and the like, such as chairs of the type that have a stationary base or support, and a back which tilts about a generally horizontal axis with respect to the support. The controller has an adjustable tension device, comprising a spring, having one end operably connected with a portion of the support, and the other end operably engaging a portion of the back at selected locations spaced apart from the tilt axis. Rearward tilting of the chair back deflects the spring, and thereby generates a torque or back tension which resists further tilting. A shifter moves the other end of the spring between the selected back locations to vary the lever arm at which the spring acts, and thereby adjust back tension.

The shifter for the spring may take several forms, including linear and rotary cam arrangements, a slide arrangement, a gear adjustor, a screw adjustor, a stored energy or quick-adjust arrangement, and various combinations of the same.

Another aspect of the present invention is a shared-load back tension device, comprising a first spring having one end operably connected with the support, and a second end operably connected with the back at a location offset from the tilt axis, such that rearward tilting of the back deflects the spring, thereby generating a first torque which resists those forces that tilt the back rearwardly. The first spring is pretensed to create a minimum, first torque, which biases the back into a normally, fully upright position. A second spring has one end operably connected with the support, and the other end operably connected with the back at a location offset from the tilt axis, whereby at least selected rearward tilting of the back abuts the second spring, thereby generating a second torque which also resists those forces that tilt the back rearwardly. The second spring includes a device for varying the amount of the second torque, such that the first and second springs combine to share the load applied to the back during tilting, with the first spring providing a minimum base torque, and the second spring providing a variable additional torque to adapt the chair for different users and various applications.

Yet another aspect of the present invention is to provide a controller which includes any one version of the the adjustable tension feature in combination with the shared-load feature.

The principal objects of the present invention are to provide a controller for seating, and the like, which is capable of readily adapting the seating for a wide variety of different users and various applications. An adjustable tension device permits the user to quickly and easily adjust the controller pretension and tilt rate while seated on the chair. A shared-load spring arrangement provides a secure feel to the back tilt, and allows the user to assume a fully upright, comfortable posture in the chair during controller adjustment. The shared-load spring arrangement also reduces the effort required to adjust spring tension. A quick-adjust version of the present invention includes unique, canned-spring arrangement to facilitate adjustment of the controller pretension and tilt rate with a minimum amount of physical effort. A control lever, located remote to the controller, such as on the arm of the chair, may be used to adjust the quick-adjust type of controller. The controller provides good body and back support throughout various tilt angles, and can be adapted to comfortably accommodate persons having vastly differing physical characteristics. The controller has a relatively uncomplicated construction, is efficient in use, economical to manufacture, capable of a long operating life, and particularly well adapted for the proposed use.

These and other features, advantages and objects of the present invention will be further understood and appreciated by those skilled in the art by reference to the following written specification, claims and appended drawings.

BRIEF DESCRIPTION OF THE DRAWINGS

FIG. 3 is a top plan view of the controller.

FIG. 4 is a side elevational view of the controller, a portion thereof broken away to reveal internal construction, and shown with the chair back in a fully upright position.

FIG. 5 is a side elevational view of the controller, with a portion thereof broken away to reveal internal construction, and shown with the chair back in a rearwardly tilted position.

FIG. 11 is a slightly enlarged, vertical cross-sectional view of the controller, shown with the quick-adjust mechanism in an engaged position at a selected back tension setting.

FIG. 12 is a slightly enlarged, vertical cross-sectional view of the controller, shown with the quick-adjust mechanism in a disengaged position for adjustment of the back tension.

FIG. 13 is an enlarged vertical cross-sectional view of the controller, shown with the quick-adjust mechanism shifted to a different back tension setting.

FIG. 16 is a perspective view of another embodiment of the controller, showing a remote adjustment device.

FIG. 17 is a side elevational view of the controller illustrated in FIG. 16, shown mounted in a tilt back chair having an arm mounted lever to adjust the controller.

DETAILED DESCRIPTION OF THE PREFERRED EMBODIMENTS

Figure 1:
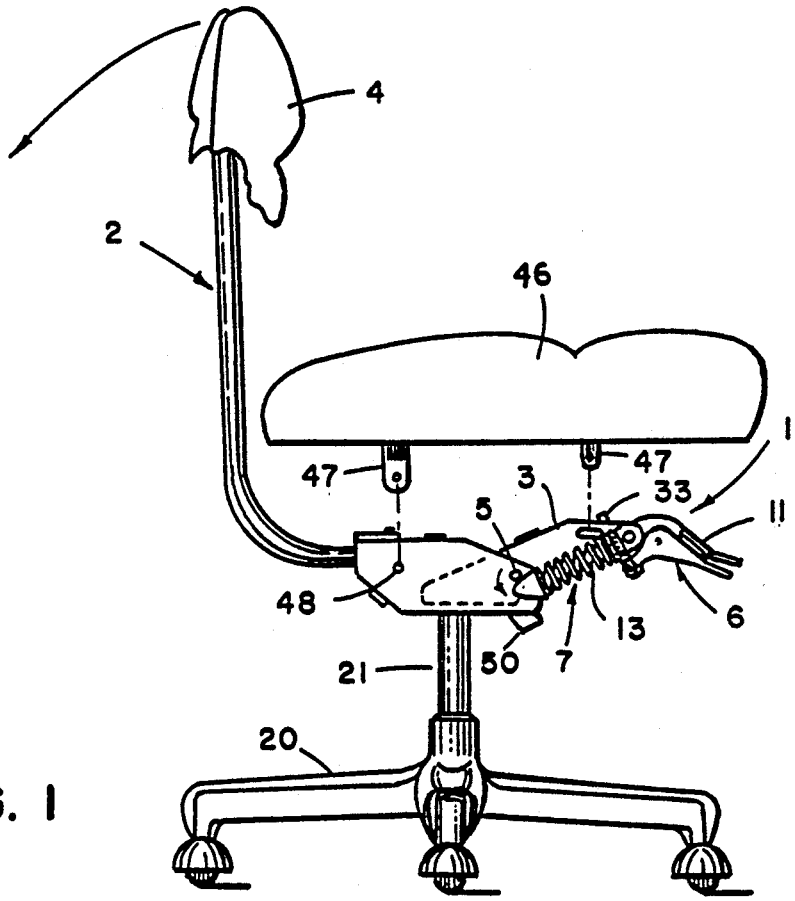
FIG. 1 is a side elevational view of a quick-adjust version of a controller embodying the present invention, shown mounted in a tilt back chair, with portions thereof broken away and exploded to reveal internal construction.

For purposes of description herein, the terms "upper," "lower," "right," "left," "rear," "front," "vertical," "horizontal," and derivatives thereof shall relate to the invention as oriented in FIGS. 1, and with respect to a seated user. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions, and other physical characteristics relating to the embodiments disclosed herein are not to be considered limiting, unless the claims expressly state otherwise.

QUICK-ADJUST CONTROLLER

The reference numeral 1 (FIGS. 1–17) generally designates a controller embodying the present invention, and is of the stored energy adjustment, or quick-adjust type, as described below. In the illustrated example, quick-adjust controller 1 is shown mounted in a tilt back chair 2 of the type having a stationary base or support 3, and a back 4 which tilts about a generally horizontal axis 5 with respect to support 3. Controller 1 includes a quick-adjust tension device 6, and a shared-load arrangement 7, which readily adapt chair 2 for different users and various applications. Quick-adjust tension device 6 comprises a spring 8 (FIG. 3), having one end 9 connected with support 3, and the other end 10 operably engaging chair back 4 at selected locations spaced apart from the tilt axis 5, such that rearward tilting of chair back 4 in the direction illustrated by the arrow in FIG. 1 deflects spring 8, and thereby generates a torque or back tension which resists further tilting. A shifter 11 moves the free end 10 of spring 8 between the selected back locations to vary the lever arm at which spring 8 acts, and thereby adjusts back tension.

The shared-load arrangement 7 (FIG. 3) contemplates combining at least one additional spring with adjustable spring 8, so as to reduce the compression force in adjustable spring 8, and thereby reduce that effort necessary to adjust spring 8. In the illustrated example, two such additional springs are provided, comprising second and third springs 12 and 13 respectively, which are positioned on opposite sides of spring 8, and are operably connected between support 3 and back 4. Springs 12 and 13 are pretensed to generate an initial torque which biases chair back 4 into a normally, fully upright position, as shown in FIG. 1. The three controller springs 8 and 11–12 combine to share the load applied to chair back 4, with the second and third springs 12 and 13 providing an initial, minimum or base back tension, and the first spring 9 providing an additional, variable back tension.

With reference to FIG. 1, the illustrated tilt back chair 2 comprises a castered base 20 in which the lower end of a vertically extending pedestal 21 is supported. Pedestal 21 comprises a hollow tube, having its upper end fixedly attached to stationary support 3.

As best illustrated in FIGS. 3–5, support 3 comprises a rigid weldment having spaced apart sidewalls 24 and 25, with their rearward ends interconnected by a laterally extending end wall 26. The terms "rearward," "forward," and the like, herein, are relative to a seated user, with chair back 4 at the "rear" of chair 2, and the free edge of bottom cushion 46 at the "front" of chair 2. Support sidewalls 24 and 25 have a side elevational shape which is generally that of a parallelogram, including upper edges 27, lower edges 28, and end edges 29 and 30. A pedestal support socket 31 is fixedly mounted between support sidewalls 24 and 25 near the rearward end of support 3. Socket 31 opens downwardly, and is shaped to closely receive the upper end of pedestal 21 therein. A reinforcing plate 32 is attached to the upper edges 27 of support sidewalls 24 and 25 to strengthen the same. The forward ends of support sidewalls 24 and 25 include laterally aligned apertures therethrough (not shown) to support shifter 11 in the fashion described below. Elongate slots 33 are provided in support sidewalls 24 and 25 to mount cushioning to support 3, as explained hereinafter.

Chair back 4 is supported on a rigid, tilt frame 38 (FIGS. 3–5), that is pivotally connected to stationary support 3 by a connector pin 39, the central axis of which defines tilt axis 5. Tilt frame 38 has an H-shape, top plan configuration, and includes opposite sidewalls 40 and 41, and a laterally extending reinforcing rib 42 extending therebetween. Tilt frame sidewalls 40 and 41 are positioned outwardly from the corresponding sidewalls 24 and 25 of stationary support 3. Connector pin 39 has its central portion rotatably supported in support 3, and its outer ends are connected with tilt frame sidewalls 40 and 41, adjacent the forward end of tilt frame 38. Tilt frame 38 supports a vertically extending back frame 43 on which chair back 4 is mounted and supported. In the illustrated structure, back frame 43 comprises a tubular, inverted U-shaped member that has its opposite ends attached to tilt frame sidewalls 40 and 41 adjacent the rearward ends thereof.

As best illustrated in FIG. 1, chair 2 includes a seat cushion 46 with downwardly extending brackets 47. The forward pair of brackets 47 are attached to support 3 at sidewall slots 33, and the rearward pair of brackets 47 are attached to tilt frame 43 at mating apertures 48 in tilt frame sidewalls 40 and 41.

It is to be understood that although controller 1 is shown mounted in a tilt back chair in the present application, the inventive concept disclosed herein also contemplates other furniture applications of the type wherein there are two mutually adjustable portions of a furniture article that require a particular type of control for their mutual adjustment.

Figure 7:
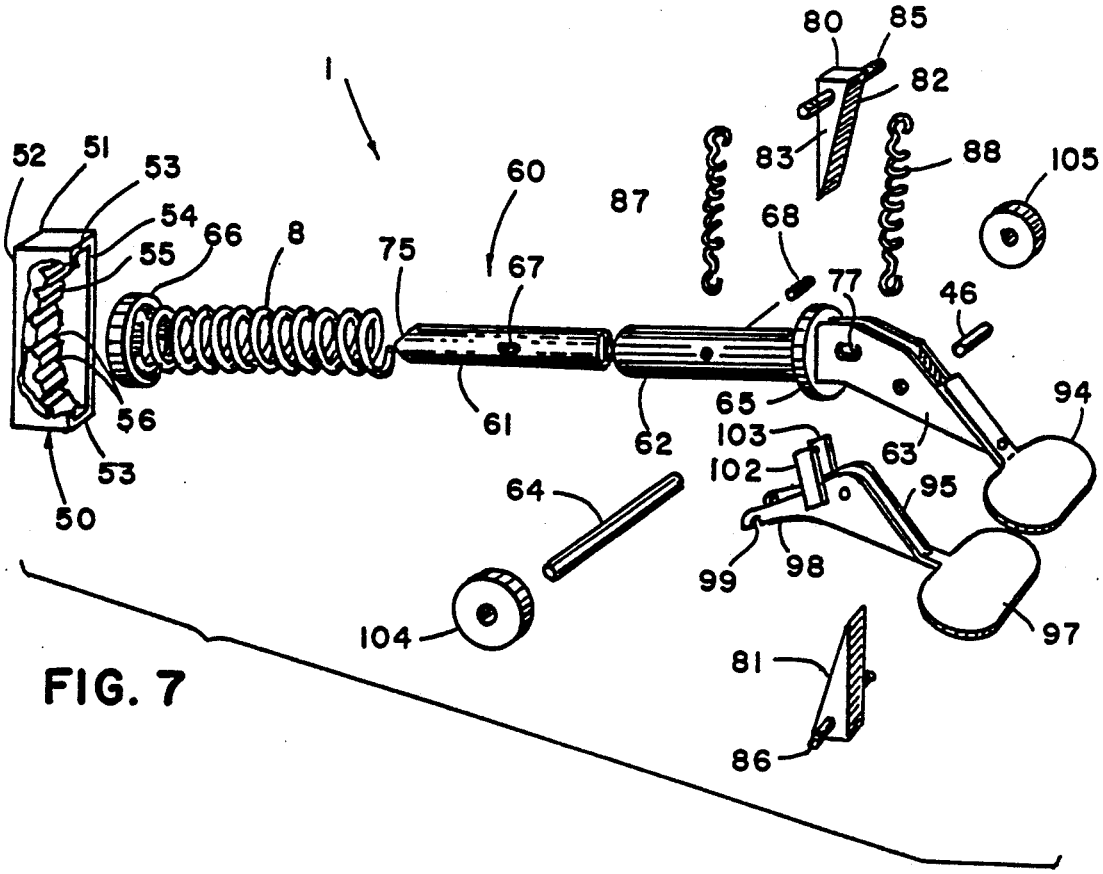
FIG. 7 is an exploded, perspective view of a quick-adjust mechanism portion of the controller.
Figure 8:
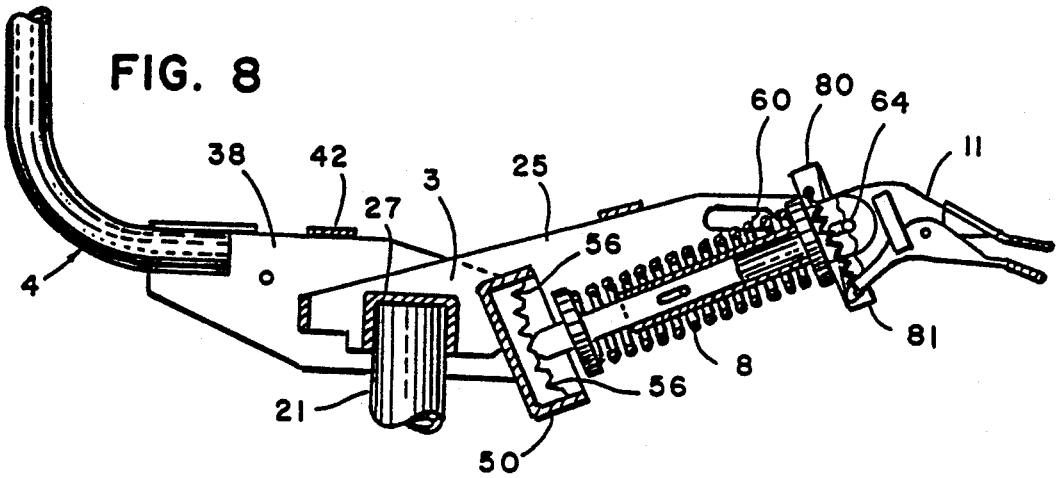
FIG. 8 is a vertical cross-sectional view of the controller, shown with the back tension at a first setting, and the chair back in a fully upright position.
Figure 9:
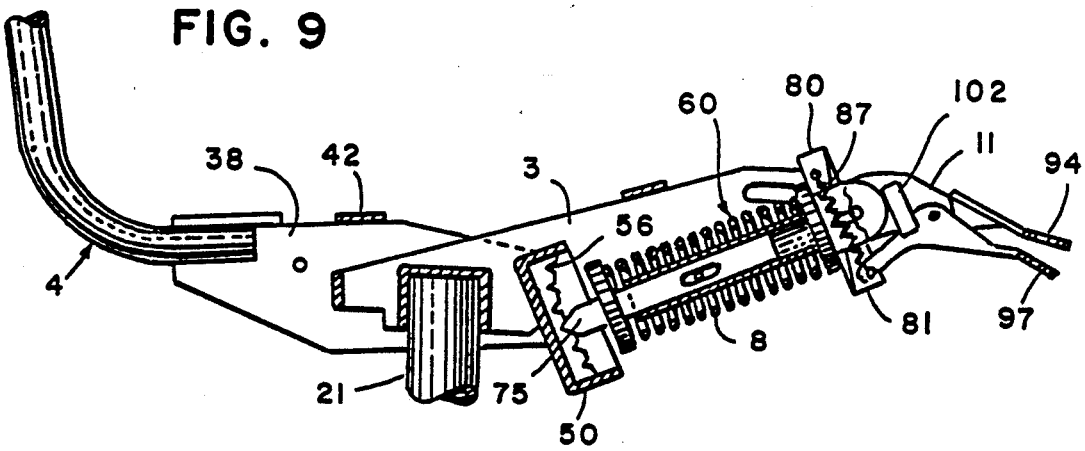
FIG. 9 is a vertical cross-sectional view of the controller, with the adjustable back tension at the first setting, and the chair back in a rearwardly tilted position.
Figure 10:
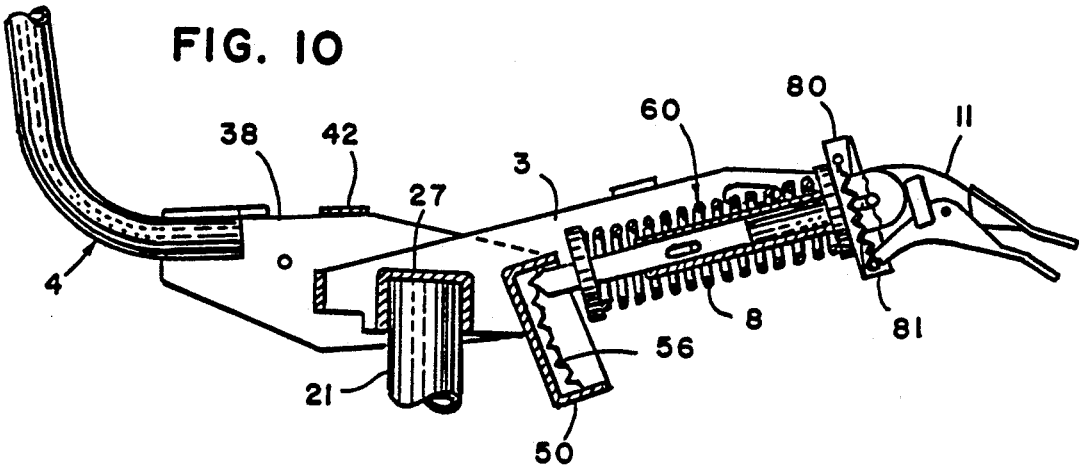
FIG. 10 is a vertical cross-sectional view of the controller, with the back tension at a second setting, and the chair back in a rearwardly inclined position.

In the quick-adjust device 6, a rack 50 (FIG. 7) is supported on tilt frame 38 (FIG. 3), at a location thereon, such that tilting of chair back 4 pivots at least a portion of rack 50 with respect to stationary support 3, as shown in FIGS. 8–10. The illustrated rack 50 is mounted in a rectangular housing 51, having a rear wall 52, upper and lower walls 53, and sidewalls 54. Rack 50 includes a generally arcuately shaped outer surface 55, with a plurality of spaced apart grooves 56 therein. In the illustrated example, the outer surface 55 of rack 50 lies along an arc having its center disposed generally coincident with the pivot axis of shifter 11 for purposes to be described hereinafter. Furthermore, the illustrated rack 50 has six grooves 56 which are spaced regularly about outer surface 55 at an angle of approximately 5 degrees apart, and each groove 56 has a generally V-shaped vertical cross-sectional configuration. It is to be understood that any number of rack grooves 56 may be provided, depending upon the number of tension settings desired.

Figure 15:
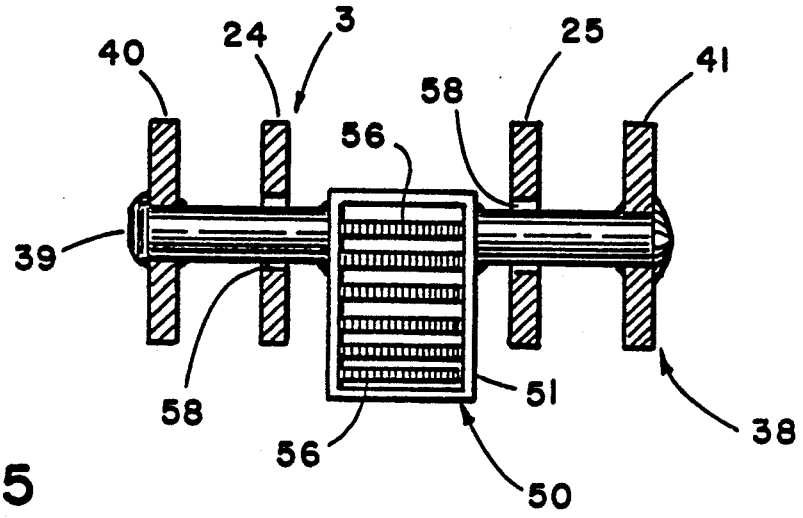
FIG. 15 is a partial, cross-sectional view of the controller taken along the line XV—XV of FIG. 4.

In the illustrated example, rack 50 is supported on connector pin 39, and rotates therewith when chair back 4 is tilted. As best shown in FIG. 15, connector pin 39 has its outer ends fixedly attached to the sidewalls 40 and 41 of tilt frame 38. Rack housing 51 is positioned centrally on connector pin 39, between the sidewalls 24 and 25 of support 3, and is fixedly attached to connector pin 39, such that tilting of chair back 4 rotates connector pin 39 and rack 50. Connector pin 39 passes through sleeve shaped bearings 58 in the sidewalls 24 and 25 of support 3 to rotatably mount tilt frame 38 on support 3. When chair back 4 is tilted rearwardly, the distance between the rack grooves 56 (except for the uppermost groove), and the forward end 9 of spring 8 is reduced, so as to deflect spring 8, as described in greater detail below. In the illustrated example, when chair back 4 is in the fully upright position (FIG. 5), the longitudinal axis of rack 50 is oriented at a preselected angle, which is shown at an angle of approximately 30 degrees from the vertical. However, the maximum back tilt angle will vary in accordance with the type of chair, intended users, environment, etc.

The term "spring 8," as used herein in relation to quick-adjust tension device 6, collectively refers to a multi-piece, canned-spring assembly 60 which is best illustrated in FIG. 7. Canned-spring assembly 60 comprises two, telescoping spring holders 61 and 62. The forward spring holder 62 is mounted on a wing-shaped bracket 63, which in turn is pivotally supported on the forward ends of support 3 by a pin 64. In the illustrated example, the forward spring holder 62 comprises a cylindrical tube in which the rearward spring holder 61 is telescopically received. A first, disc-shaped spring stop or retainer 65 is mounted at the forward end of spring holder 62, and is adapted to abut the forward end of spring 8. A second, disc-shaped spring stop or retainer 66 is attached to spring holder 61, adjacent the free end thereof, and is shaped to abut with the rearward end of spring 8. Spring holder 61 includes a longitudinally extending, elongated slot 67, which mates with a pin 68 that extends through spring holder 62, so as to limit the longitudinal movement between spring holders 61 and 62, as illustrated in FIGS. 8 and 9. Spring 8 is mounted over spring holders 61 and 62, and in this example, comprises a compression coil spring. Spring 8 is preferably pretensed, such that when spring holders 61 and 62 are in their fully extended position, spring 8 is tensed or loaded, exerting a preselected resilient force between retainers 65 and 66.

The free end of rearward spring holder 61 includes a V-shaped tooth 75 that is shaped to be closely received in the grooves 56 of rack 50. During the operation of controller 1, the tooth portion 75 of spring assembly 60 is positioned in one of the rack grooves 56, such that rearward tilting of chair back 4 rotates rack 50 forwardly, thereby further compressing spring 8, which resists further rearward rotation of chair back 4 (except when positioned in the uppermost rack groove). Since rack grooves 56 are spaced at different intervals from the tilt axis 5, the lever arm at which spring 8 acts on chair back 4 is varied to adjust both the pretension and tilt rate of controller 1.

In the illustrated example, quick-adjust shifter 11 translates spring 8 longitudinally, as illustrated in FIGS. 11–13, so as to engage and disengage tooth 75 with rack grooves 56. Bracket 63 (FIG. 7) includes an elongated slot 77 in which pin 64 is received. Hence, pin 64 not only rotatably mounts canned-spring assembly 60 on support 3, but also permits the same to shift forwardly and rearwardly. A pair of oppositely oriented wedges 80 and 81 are positioned between spring retainer 65 and pin 64 to block the space defined therebetween, and thereby facilitate the transmission forces from the forward end of spring 8 to support 3 and through pin 64. Wedges 80 and 81 have a generally triangular side elevational shape, and include inclined faces 82, side faces 83 and end faces 84. A pair of pins 85 and 86 extend laterally through the large ends of wedges 80 and 81 respectively. The illustrated wedges 80 and 81 are substantially identical, with a right triangle shape. A pair of coil springs 87 and 88 have their opposite ends attached to pins 85 and 86, so as to resiliently pull or converge wedges 80 and 81 together. As best illustrated in FIGS. 8–10, wedges 80 and 81 are oriented so that the inclined faces 82 mate, and slide over each other as the wedges converge and diverge.

Quick-adjust shifter 11 also includes a cam assembly (FIG. 7) which both diverges wedges 80 and 81, and simultaneously pulls canned-spring assembly 60 forwardly to disengage tooth 75 from the selected rack groove 56. In the illustrated example, shifter 11 looks like a duck bill, with bracket 63 having a thumb plate 94 mounted at the forward portion thereof. A pivoting arm 95 is rotatably attached to a medial portion of bracket 63 by a pin 96. Pivot arm 95 also includes a thumb plate 97 at its forward end, which is shaped similar to thumb plate 94. Pivot arm 95 includes rearward ends 98 with notches 99 in which the pin 86 of lower wedge 81 is received. The pin 85 of upper wedge 80 abuts the upper edges of bracket 63 at a location adjacent to spring retainer 65. When thumb plates 94 and 96 are converged, pivot arm 95 diverges wedges 80 and 81 to permit the canned-spring assembly 60 to be moved forwardly until pin 64 engages the rearward end of slot 77, as shown in FIG. 12. When thumb plates 94 and 97 are released, springs 87 and 88 converge wedges 80 and 81 until pin 64 engages the forward end of slot 77, as shown in FIG. 11.

A pair of cam arms 102 and 103 (FIG. 7) are attached to pivot arm 95, and protrude generally upwardly and rearwardly therefrom. Disc-shaped bearings 104 and 105 are mounted on pin 64, on opposite sides of bracket 63, and are positioned to abut cam arms 102 and 103. When thumb plates 94 and 97 are converged, not only are wedges 80 and 81 thereby diverged so as to permit lateral translation of canned-spring assembly 60, but also cam arms 102 and 103 abut bearings 104 and 105, and simultaneously pull canned-spring assembly 60 forwardly, thereby disengaging tooth 75 from the rack grooves 56, as shown in FIG. 12. When thumb plates 94 and 97 are released, springs 87 and 88 automatically converge wedges 80 and 81, thereby pushing canned-spring assembly 60 rearwardly, and engaging tooth 75 in a selected one of the rack grooves 56, as shown in FIG. 11.

With reference to FIGS. 8–10, rack 50 is positioned at a selected location with respect to tilt axis 5 and support pin 64. Initially, each of the rack grooves 56 is oriented symmetrically with imaginary planes extending from support pin 64 through the centers of the grooves. Thus, rack grooves 56 are arranged in a radially extending, and arcuately spaced apart relationship with support pin 64, similar to the arcuate orientation of the outer surface 55 of rack 50. The uppermost one of the rack grooves 56 (as viewed in FIGS. 8–10) lies substantially coincident with the tilt axis 5 of chair back 4. As a result, when chair back 4 is tilted rearwardly with spring tooth 75 in the uppermost one of rack grooves 56, spring 8 is not further compressed, and provides no additional back tension. This tension setting corresponds to line "L" in FIG. 14. The lowermost one of the rack grooves 56 (as viewed in FIGS. 8–10) lies furthest away from the tilt axis 5 of chair back 4. As a result, when chair back 4 is tilted rearwardly with spring tooth 75 in the lowermost one of rack grooves 56, spring 8 is further compressed to its maximum amount, and provides maximum additional back tension. This tension setting corresponds to line "H" in FIG. 14. The intermediate four rack grooves 56 are spaced apart in differing amounts from the tilt axis 5 of chair back 4. When spring tooth 75 is engaged in one of these four intermediate grooves, spring 8 is further compressed in amounts incremental to the offset of the intermediate groove from tilt axis 5 to provide four different additional back tensions. These tension settings correspond to lines I*a*, I*b*, I*c* and I*d* in FIG. 14, with line I*a* representing the lowermost one of the intermediate grooves (as viewed in FIGS. 8–10).

In the shared-load arrangement 7, springs 12 and 13 (FIGS. 3–5) are mounted on holders similar to canned-spring assembly 60, and include retainers 108 and 109 and telescoping spring holders 110 and 111. A pin 112 interconnects telescoping members 110 and 111, and is received in an elongate slot in member 113. Springs 12 and 13 are positioned over telescoping spring holders 110 and 111, and have their opposite ends in abutment with retainers 108 and 109. The illustrated springs 12 and 13 are compression coil springs, and are preferably pretensed, such that when spring holders 110 and 111 are in their normally fully extending position, springs 12 and 13 are tensed or loaded. The forward retainer ends 108 are pivotally mounted on pin 64, and the rearward retainer ends 109 are pivotally attached to the forward portion of tilt frame 38 by pins 113. The pretension in springs 12 and 13 biases chair back 4 into the normally, fully upright position illustrated in FIGS. 4 and 8, and resiliently retains the same therein. When chair back 4 is tilted rearwardly, springs 12 and 13 are further compressed, thereby generating additional torque about tilt axis 5, which resists further tilting. The illustrated springs 12 and 13 are substantially identical, and are mounted in a generally parallel relationship with each other, as well as spring 8.

The cooperation and interaction between quick-adjust device 6 and shared-load arrangement 7 permits controller 1 to be easily and quickly adjusted by a user, while sitting in a comfortable position in chair 2. Hence, the user can quickly determine, through actual use or trial and error, that back tension setting which is most comfortable for him or her for the particular task to be performed. The seated user simply tilts chair back 4 rearwardly, and if the back tension is too stiff or too light, returns the chair back to the fully upright position, and manipulates shifter 11 to obtain more or less back tension, as desired. The seated user then tilts chair back 4 again to determine if the newly selected tension setting is satisfactory. If further adjustment is desired, the user simply returns chair back 4 to its fully upright position, and makes whatever additional adjustments are necessary to obtain maximum comfort for the individual user.

Quick-adjust device 6 is designed to be adjusted only when chair back 4 is in the fully upright position. With reference to FIG. 8, when chair back 4 is in the fully upright position, the distance between rack 50 and support pin 64 is at its greatest measure, and spring 8 does not transmit any force between rack 50 and support 3. Hence, there is no load on or between the moving elements of quick-adjust device 6, such as support pin 64, bracket 63, wedges 81 and 82, etc., thereby facilitating easy manipulation of the adjustment mechanism, and greatly alleviating wear between the various parts. However, since the average user normally exerts some slight rearward force or pressure on seat back 4 when seated in a natural, comfortable position in chair 2, it is necessary to isolate this force from quick-adjust device 6. The shared-load arrangement 7, through the preloading or pretensing of springs 12 and 13, resists such slight, initial tilting forces, and permits the seated user to easily and quickly manipulate the quick-adjust device 6 in a no-load condition. To properly manipulate quick-adjust device 6 without shared-load arrangement 7, the user would be required to get up from chair 3, turn bodily around to face the chair, reach under the chair to grasp and manipulate shifter 11, turn back around in front of the chair, and lower himself back into the seated position. These additional motions greatly reduce the efficiency of the worker, and may discourage the worker from adjusting chair 2 to its level of maximum comfort, thereby causing unnecessary fatigue.

In operation, quick-adjust controller 1 functions in the following manner. Springs 12 and 13 resiliently bias chair back 4 into its normally, fully upright position, as shown in FIG. 4. It is to be understood that controller 1 may have a different number of shared-load springs, such as one, three, or even more. Since springs 12 and 13 are pretensed, a minimum, initial torque is generated at tilt axis 5, which resists rearward tilting of chair back 4. To tilt chair back 4 rearwardly, the seated user must first impart sufficient rearward force to overcome this initial torque. When chair back 4 is tilted rearwardly, as illustrated in FIG. 5, tilt frame 22 rotates about tilt axis 5, thereby further compressing springs 8, 12 and 13, which generates an additional torque at tilt axis 5, which resists further rotation of chair back 4.

Figure 14:
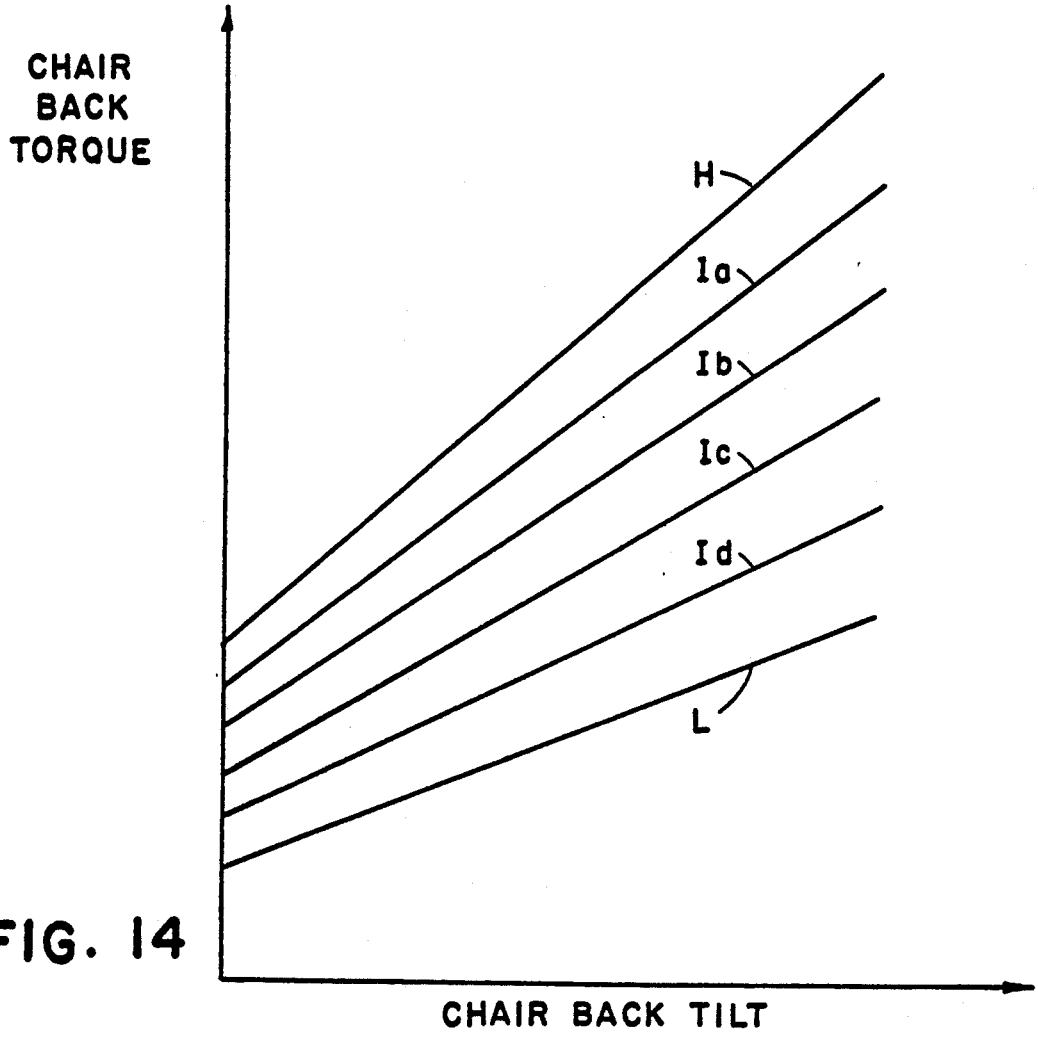
FIG. 14 is a graph illustrating chair back torque as a function of chair back tilt.

As discussed above, canned-spring assembly 60 can be shifted to vary the amount of additional torque at tilt axis 5. When spring tooth 75 is located in the uppermost groove 56 of rack 50, spring 8 is not compressed at all as chair back 4 is tilted rearward, since groove 56 is positioned on center with tilt axis 5. Hence, back tension is generated only by springs 12 and 13. With reference to FIG. 14, the graph line identified as "L" corresponds to the spring position illustrated in FIG. 10, which is typically selected by lightweight users.

Figure 2:
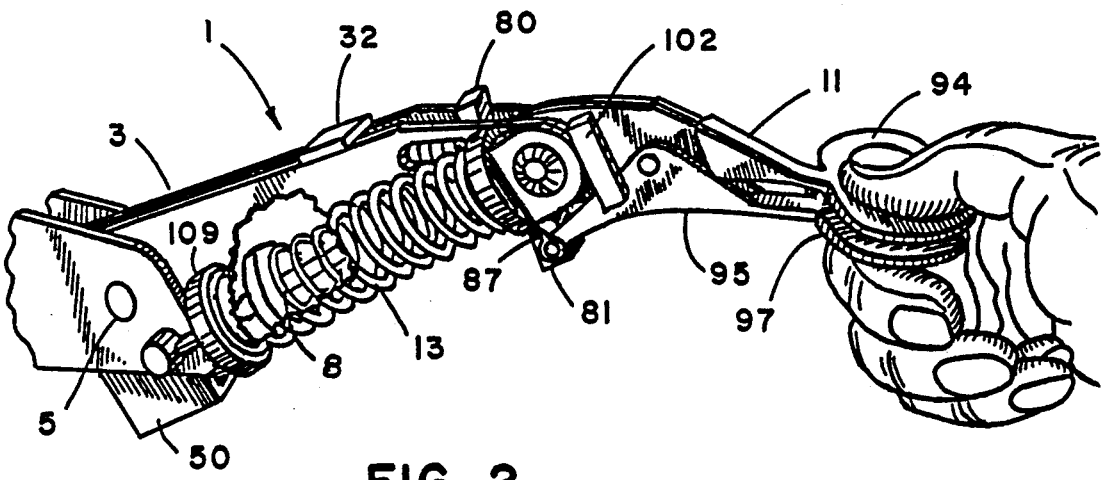
FIG. 2 is a perspective view of the controller, with portions broken away to reveal internal construction, and shown being adjusted by a user.
Figure 6:
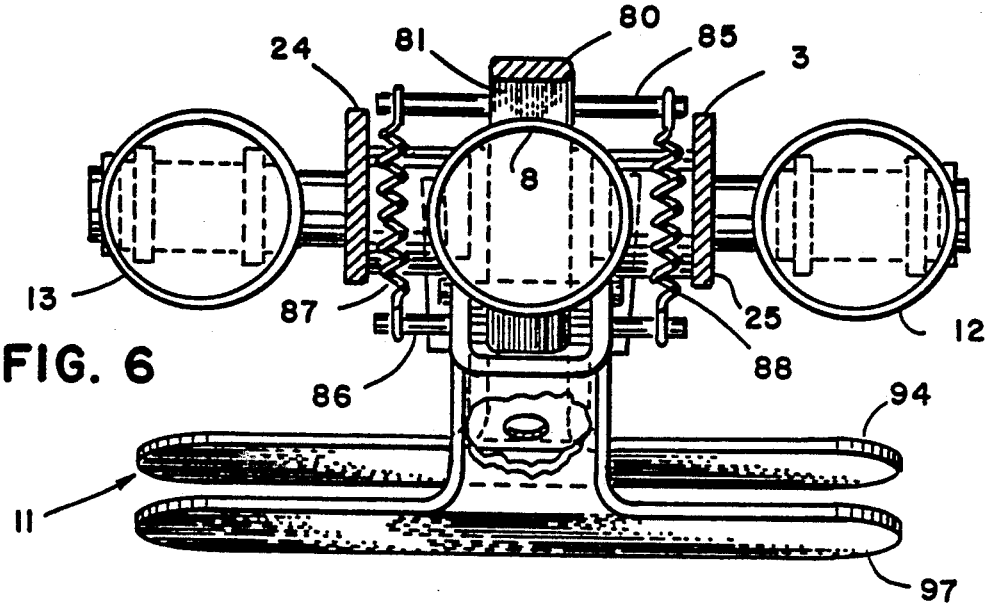
FIG. 6 is a partial, cross-sectional view of the controller, taken along the line VI—VI of FIG. 4.

In the event that the user wishes to increase back tension, the user shifts his weight toward the front of the chair, such that springs 12 and 13 automatically rotate chair back 4 into its fully upright position. In this position, the user pinches or converges thumb plates 94 and 97, as shown in FIG. 2, thereby disengaging spring tooth 75 from rack 50, and permitting canned-spring assembly 60 to be rotated about pin 64. The user then rotates canned-spring assembly 60 in a counterclockwise direction, as viewed in FIGS. 8–10, to a new, selected position. The user then releases thumb plates 94 and 97, thereby engaging spring tooth 75 in the new, selected rack groove 56. In this position, rearward tilting of chair back 4 is resisted not only by springs 12 and 13, but also by spring 8. The lever arm at which spring 8 acts about tilt axis 5 is thereby varied to adjust both the pretension and the tilt rate of controller 1.

The reference numeral la (FIGS. 16 and 17) designates a remotely controlled embodiment of the quick-adjust controller. Since controller **1*a* is similar to the previously described controller 1, similar parts appearing in FIGS. 1–15 and 16–17 respectively are represented by the same, corresponding reference numeral, except for the suffix "a" in the numerals of the latter. Controller 1*a* includes a remote control device 125 to operate controller 1*a* from a convenient location from chair 2*a*. In the illustrated example, remote control 125 comprises a lever arm 126 pivotally mounted on the arm 127 of chair 2*a*. A pair of control cables 128 and 129 are operably connected with lever arm 126, such that pivoting of lever arm 126 extends and retracts the cable portion of the control cables. The upper end of control cable 129 has its housing portion 130 attached to pivot arm 95*a*, and its reciprocating cable portion 131 attached to bracket 63*a*. Hence, rotation of lever arm 126 converges and diverges thumb plates 94*a* and 97*a*, so as to engage and disengage tooth 75*a* from rack grooves 56*a*. The upper end of control cable 128 has its housing portion 132 connected with pin 64*a***, and the cable portion 133 attached to bracket 63*a*. Hence, rotation of lever arm 126 rotates bracket 63*a* with respect to pin 64*a*. A conventional, mechanical synchronizer (not shown) is included in lever arm 126, such that initial rotation of lever arm 126 converges thumb plates 94*a* and 97*a* first, and then continued rotation of lever arm 126 rotates bracket 63 about pin 64.

Controllers 1 and 1*a* include the quick-adjust tension device and the shared-load arrangement, which readily adapt the chair for a wide variety of different users and various applications. The canned-spring arrangement facilitates adjustment of the controller pretension and tilt rate with a minimum amount of physical effort, and can even be operated by a remote controller. The controller can be easily and quickly adjusted by a user sitting in the seat, so that the user can quickly ascertain or determine, through actual use, that back tension which is most comfortable for him or her for a particular task. The controller is capable of accommodating individuals having vastly differing physical characteristics, and provides good body and back support through all tilt angles.

SCREW SHIFTER CONTROLLER

The reference numeral 1*b* (FIGS. 18–23) designates a screw shifter version of the controller embodying the present invention. Since controller 1*b* has portions similar to the previously described controllers 1 and 1*a*, similar parts appearing in FIGS. 1–15 and FIGS. 18–23 respectively are represented by the same corresponding reference numeral, except for the suffix "b" in the numerals of the latter. One basic difference between quick-adjust controller 1 and screw shifter controller 1*b* is that in controller 1*b* (FIGS. 21–23), adjustable springs 138 and 139 remain engaged with their mating rack or abutment surface at all times, in contrast to the single adjustable spring 8 of the quick-adjust controller 1, wherein spring 8 shifts between engaged and disengaged positions with rack 50. As a result, the force required to adjust quick-adjust controller 1 is negligible, while friction forces must be overcome to adjust screw shifter controller 1*b*. Also, a screw type of shifter 11*b* is provided in controller 1*b* to vary the lever arm at which springs 138 and 139 act with respect to tilt axis 5*b* of chair back 4*b*, as opposed to the quick-adjust assembly 6 of controller 1.

Figure 20:
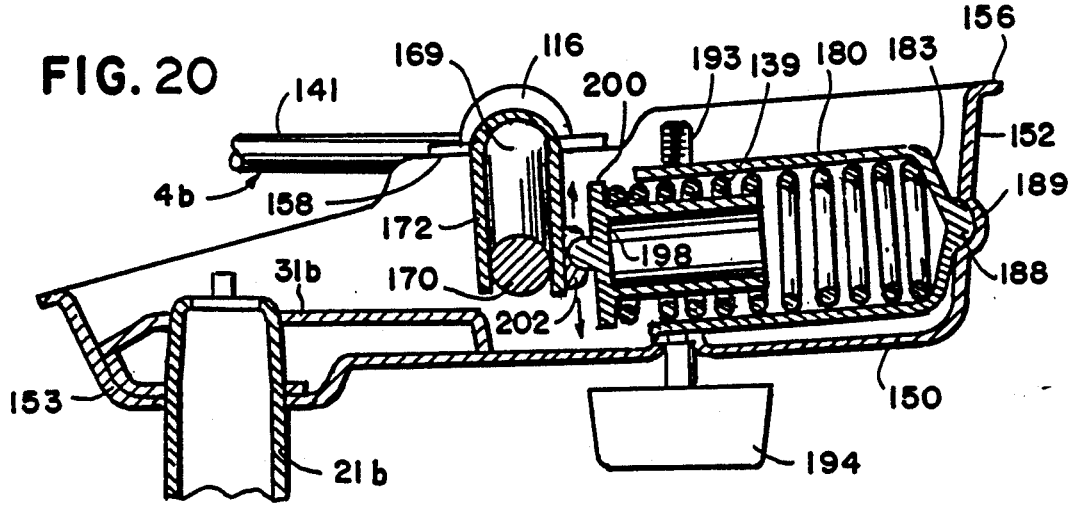
FIG. 20 is a vertical cross-sectional view of the screw shifter controller, shown with the back tension at a second setting, and the chair back in the fully upright position.
Figure 21:
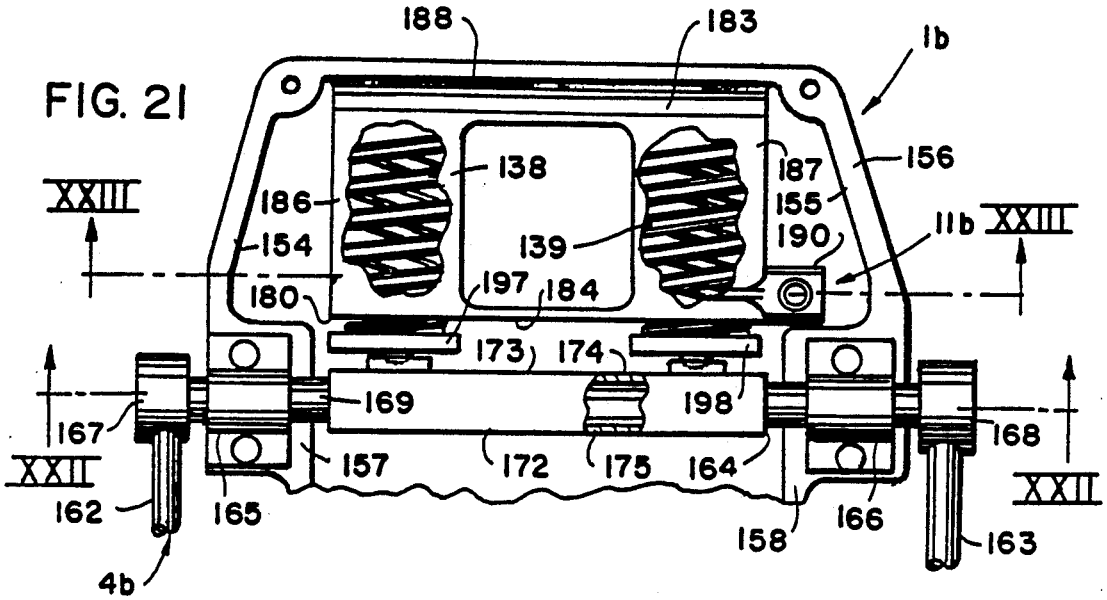
FIG. 21 is a fragmentary, top plan view of the screw shifter controller.

In the illustrated example, controller 1*b* (FIGS. 18–20) includes a formed, cup-shaped, sheet metal housing 150, which includes a socket 31*b* in which pedestal 21*b* is received to support chair 2*b* on a base (not shown). Control housing 150 includes a base wall 151, a front wall 152, a rear wall 153, and opposite sidewalls 154 and 155. As best illustrated in FIG. 21, the upper edges of control housing 150 are flared outwardly to form a flange 156, which extends along the marginal edge of control housing 150, and includes two enlarged pad areas 157 and 158 adjacent the medial portions of sidewalls 154 and 155. A sleeve 159 (FIG. 23) is mounted in the base wall 151 of control housing 150, and serves to rotatably support screw shifter 11*b* in the manner described below.

Figure 22:
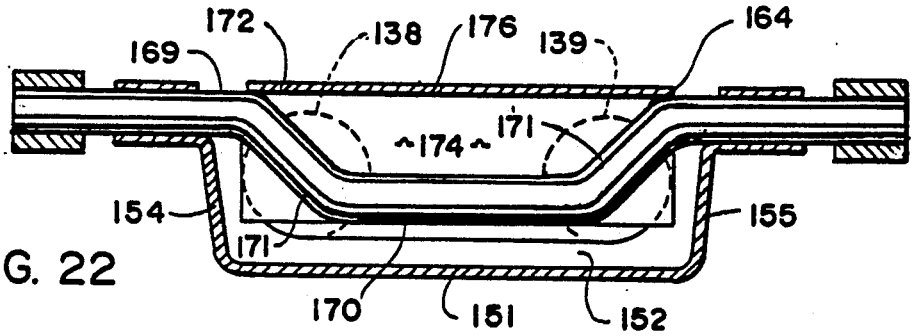
FIG. 22 is a vertical cross-sectional view of the screw shifter controller, taken along the line XXII—XXII of FIG. 21.

Chair back 4*b* (FIGS. 21–23) is supported on a rod-shaped frame having two arms 162 and 163 extending rearwardly from the pads 157 and 158 of control housing 150. A bell crank 164 is rotatably supported on control pads 157 and 158 by a pair of pillow block type bearings 165 and 166. The forward ends of back frame arms 162 and 163 are fixedly attached to the outer ends of bell crank 164 by a pair of bushings 167 and 168, such that rearward tilting of chair back 4*b* rotates bell crank 164. As best illustrated in FIG. 22, bell crank 164 includes a formed rod 169 with a generally U-shaped medial portion, comprising a base segment 170 and oppositely inclined side segments 171. Bell crank 164 also includes a sheath or cover 172 which envelops the medial portion of rod 169, and defines a substantially planar abutment surface 173 which interacts with springs 138 and 139 in the manner described in greater detail below. In the illustrated example, sheath 172 comprises a rigid, formed sheet of sheet metal or the like, having an inverted U-shaped configuration, comprising opposite flanges 174 and 175, and an arcuate web 176. The flanges 174 and 175 of sheath 172 are spaced apart a distance substantially equal to the outside diameter of rod 169, so that it is received closely over the medial portion thereof. Sheath 172 is fixedly attached to the medial portion of rod 169 by suitable means, such as welding or the like, such that abutment surface 173 rotates with rod 169 when chair back 4*b* tilts.

Springs 137 and 138 (FIGS. 21–23) are mounted in control housing 150 by a separate spring housing 180. The illustrated spring housing 180 includes two halves, comprising an upper wall 181, and a lower wall 182. Spring housing 150 has a closed front edge 183, and an open rear edge 184. The sides of spring housing walls 181 and 182 have a semi-cylindrical configuration to define cylindrical apertures or barrels 186 and 187 in which coil springs 137 and 138 are closely received and retained. A semi-cylindrical rib 188 (FIGS. 18–20) extends along the front edge 183 of spring housing 180, and is rotatably received in a mating channel 189 in the front wall 152 of control housing 150.

Figure 23:
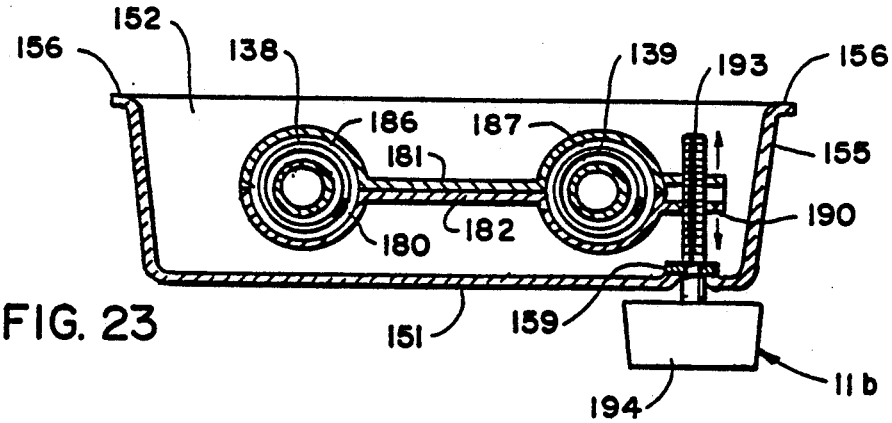
FIG. 23 is a vertical cross-sectional view of the screw shifter controller, taken along the line XXIII—XXIII of FIG. 21.

As best illustrated in FIGS. 21 and 23, spring housing 180 includes an arm 190 which extends laterally from spring barrel 187 toward the sidewall 155 of control housing 150. Arm 190 includes a vertically oriented threaded aperture in which the upper end of shifter 11*b* is received in the manner described in greater detail hereinafter.

Shifter 11*b* (FIG. 23) comprises a threaded rod 193, having a knob 194 attached to a lower end thereof for axial rotation therewith. Threaded rod 193 has an annular groove adjacent its lower end which is rotatably received in bushing 159. The upper end of threaded rod 193 is threadedly engaged in the threaded aperture of arm 190. Rotation of knob 194 shifts the rearward end of spring housing 180 upwardly and downwardly, pivoting spring housing 180 with respect to control housing 150 about rib 188 in the direction of the arrows shown in FIGS. 18 and 20. In the illustrated example, threaded rod 183 is disposed laterally on one side of spring housing 150. However, threaded rod 183 may also be located centrally in spring housing 180, such as between springs 138 and 139 to alleviate torsional forces on spring housing 150.

Coil springs 137 and 138 (FIG. 21) are mounted in the barrels 186 and 187 of spring housing 180, and have their free ends extending outwardly from the rearward edge 184 thereof. A pair of spring guides 197 and 198 are mounted on the free ends of coil springs 137 and 138. Each of the spring guides 197 and 198 includes an inner, cylindrical portion 199 (FIG. 18) shaped to be received within the interior of coil springs 137 and 138, and a circular stop portion 200 which abuttingly engages the free ends of springs 137 and 138. A semispherical knob 201 projects forwardly from the front surface of stop 200. Each coil spring 137 and 138 includes a bearing pad 202, with a semispherical recess 201 in the forward side thereof in which knob 201 is pivotally received, and an abutment surface 204 on the opposite side of recess 203. Bearing surface 204 is slidingly received on and abuts against surface 173 of sheath 172, and thereby transmits resilient force from springs 137 and 138 to bell crank 164.

Figure 18:
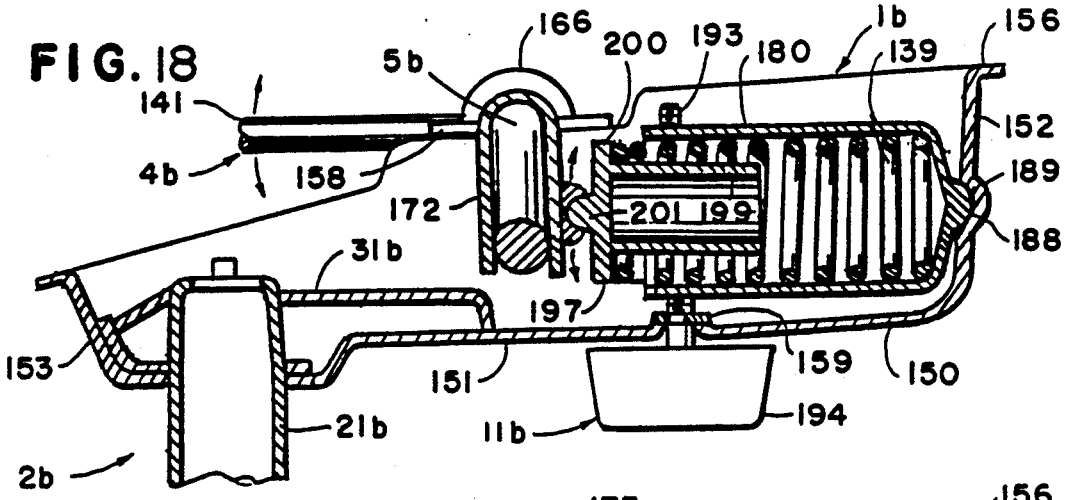
FIG. 18 is a vertical cross-sectional view of a screw shifter embodiment of the present invention, shown with the back tension at a first setting, and the chair back in a fully upright position.
Figure 19:
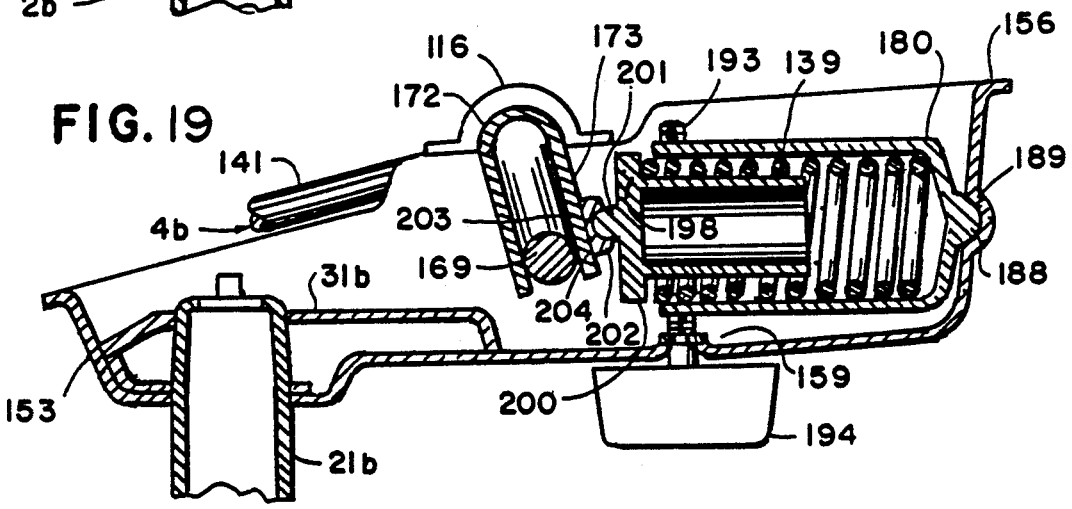
FIG. 19 is a vertical cross-sectional view of the screw shifter controller illustrated in FIG. 18, shown with the back tension at the first setting, and the chair back in a rearwardly tilting, position.

In operation, screw shifter controller **1*b* operates in the following fashion. Springs 137 and 138 are normally pretensed in spring housing 180 to apply resilient force to bell crank 164 when chair back 4*b* is in the fully upright position, as illustrated in FIGS. 18 and 20. When chair back 4*b* is tilted rearwardly, as illustrated in FIG. 19, springs 137 and 138 are further compressed to generate additional force which resists further rearward tilting of chair back 4*b*. To adjust both the pretension and tilt rate of chair back 4*b*, the user simply grasps and rotates knob 194 axially, thereby pivoting spring housing 180 in either a clockwise or counterclockwise direction, as oriented in FIGS. 18–20. Rotation of spring housing 180 causes bearing pads 202 to slide along bell crank surface 173 either toward or further away from the tilt axis 5*b* of chair back 4*b*, in the directions illustrated by the arrows in FIGS. 18 and 20. When spring housing 180 is shifted in a manner which moves bearing pads 202 closer to the tilt axis 5*b* of chair back 4*b*, the back tension is reduced, since the lever arm at which springs 137 and 138 act is decreased. When spring housing; 180 is rotated in the opposite direction, moving bearing pads 202 away from the tilt axis 5*b* of chair back 4*b*, the back tension is increased, since the lever arm at which springs 137 and 138** act is increased.

CAM SHIFTER CONTROLLER

Figure 24:
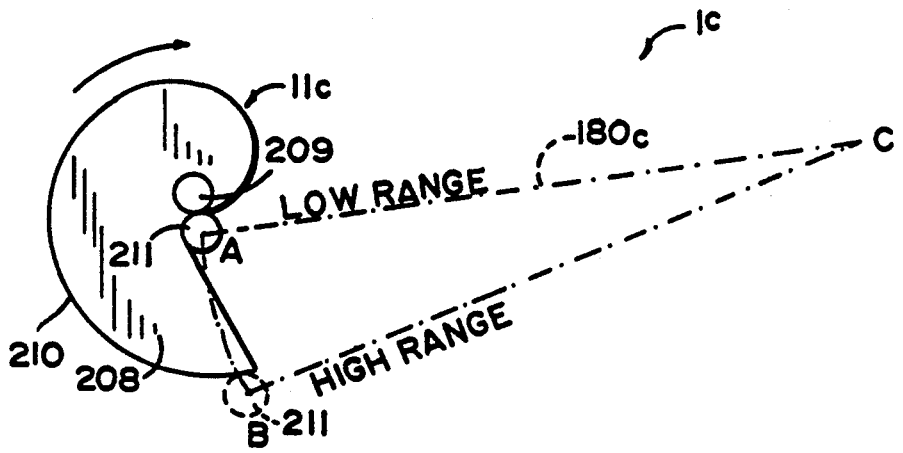
FIG. 24 is a schematic illustration of a cam shifter embodiment of the present invention.

The reference numeral **1*c* (FIG. 24) designates a cam shifter version of the controller embodying the present invention. Since cam shifter controller 1*c* is similar to the previously described screw shifter controller 1*b*, similar parts appearing in FIGS. 18–23 and 24 respectively are represented by the same, corresponding reference numeral, except for the suffix "c" in the numerals of the latter. Cam shifter controller 1*c* incorporates a cam type of shifter 11*c* to pivot spring housing 180*c* about point "c" between a low back tension position designated by the reference letter "A," and a high back tension position designated by the reference letter "B." In the illustrated example, cam shifter 11*c* includes disc-shaped element 208 which is mounted on a rod or axle 209 for axial rotation. Disc 208 includes a spiral cam surface 210 which extends from a position adjacent to axle 209 (adjacent reference point "A") to a location spaced apart from axle 209 at reference position "B." A cam guide 211 is mounted on spring housing 180, and rides against cam surface 210, such that when disc element 208 is rotated axially in the direction illustrated by the arrow in FIG. 24**, back tension is shifted between the high and low ranges.

SLIDE SHIFTER CONTROLLER

Figure 25:
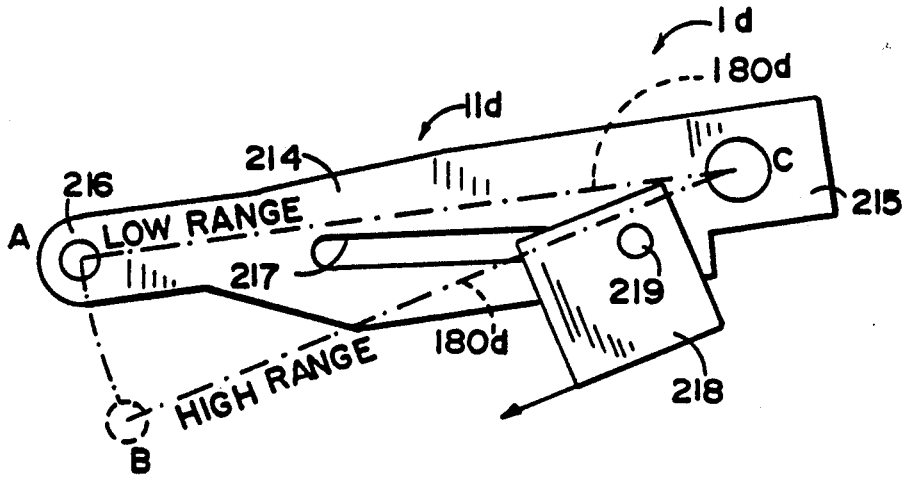
FIG. 25 is a schematic illustration of a slide shifter embodiment of the present invention.

The reference numeral **1*d* (FIG. 25) designates a slide shifter version of the controller embodying the present invention. Since slide shifter controller 1*d* is similar to the previously described screw shifter controller 1*b*, similar parts appearing in FIGS. 18–23 and 25 respectively are represented by the same, corresponding reference numeral, except for the suffix "d" in the numerals of the latter. Slide shifter controller 1*d* includes a slide type of shifter 11*d*, comprising an arm 214 having one end 215 pivotally mounted in the control housing (not shown), and the opposite end 216 pivotally attached to spring housing 180*d*. Arm 214 includes an elongate slot 217 extending along the medial portion thereof in a general longitudinal orientation. Controller 1*d* includes a slide 218 with a pin 219 received in the slot 217 of arm 214 to slide therealong. Slide 218 is shifted by a drive mechanism (not shown) along a line of motion that is not parallel with the central axis of slot 217, as illustrated by the arrow in FIG. 25. As a result, movement of slide 218 rotates arm 214 about end 215** at pivot point "c", thereby pivoting the spring housing between the low range noted by the reference letter "A," and the high range noted by the reference letter "B."

Gear Shifter Controller

Figure 26:
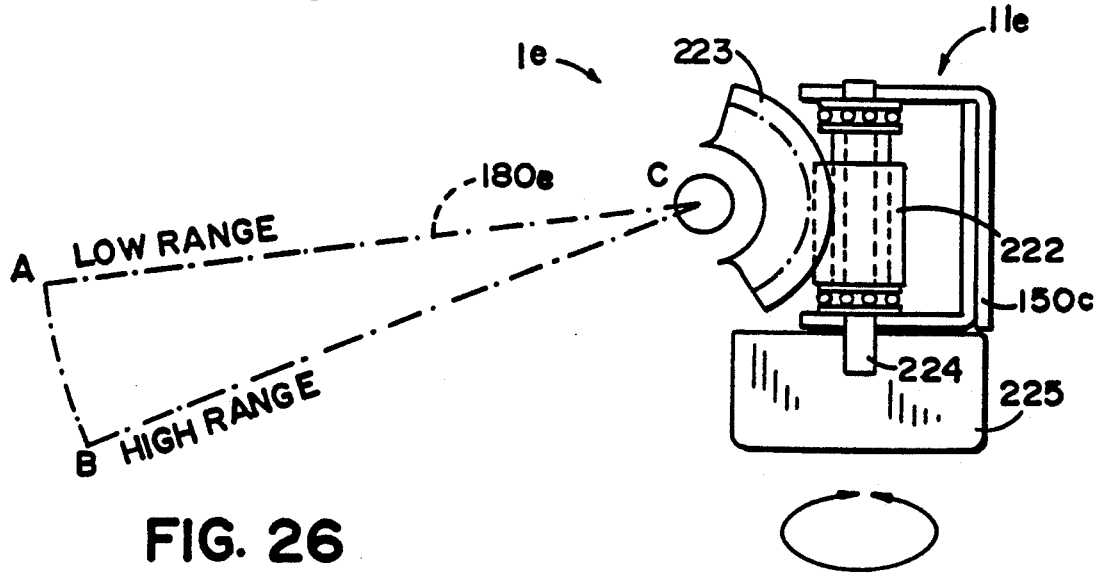
FIG. 26 is a schematic illustration of a gear shifter embodiment of the present invention.

The reference numeral **1*e* (FIG. 26) designates a gear shifter version of the controller embodying the present invention. Since gear shifter controller 1*e* is similar to the previously described screw shifter control 1*b*, similar parts appearing in FIGS. 18–23 and 26 respectively are represented by the same, corresponding reference numeral, except for the suffix "e" in the numerals of the latter. Gear shifter controller le includes a gear actuated shifter 11*e*. In the illustrated example, shifter 11*e* comprises single enveloping worm gearing, comprising a worm 222, and a mating worm gear 223. Worm 222 is rotatably mounted in control housing 150*c* by an axle 224. A knob 225 is attached to the free end of axle 224, and facilitates axial rotation of worm 222 in the direction illustrated by the double header arrow in FIG. 26. Worm gear 223 is connected with spring housing 180*e*, and rotates therewith, such that rotation of knob 225 pivots spring housing 180*e*** about pivot point "c" between the low range position noted by the reference letter "A," and the high range position noted by the reference letter "B."

As will be appreciated by those having skill in the art, other types of shifter arrangements may be provided to shift the spring housing 180 and associated springs 138 and 139 between the high range and low range positions. Such shifter arrangements may include various combinations of the shifters **11–11*e*** described and illustrated herein.

In the foregoing description, it will be readily appreciated by those skilled in the art that modifications may be made to the invention without departing from the concepts disclosed herein. Such modifications are to be considered as included in the following claims, unless these claims by their language expressly state otherwise.

We claim:

1. In a chair of the type having a support and a back which tilts about an axis with respect to said support, the improvement of an adjustable, back tension controller comprising:

an abutment surface disposed on said back, and including a plurality of selected locations which are spaced apart different distances form said tilt axis;

a spring having a first end thereof connected with said support, and a second end thereof operably engaging the abutment surface of said back at the selected locations thereon, whereby rearward tilting of said back deflects said spring, thereby generating a torque which resiliently resists rearward tilting of said back; and means for shifting said spring second end between the selected locations on said back, whereby said back tension controller is easily and quickly adjusted to adapt said chair for different users and various applications.

2. A chair as set forth in claim 1, wherein:

said spring first end is pivotally mounted on said support, such that rotation of said spring about the first end thereof varies the position of said spring second end with respect to the abutment surface of said back, and defines at least a portion of said spring shifting means.

3. A chair as set forth in claim 2, including:

means for preloading said spring, whereby rearward tilting of said back from a fully upright position is resisted by an initial torque.

4. A chair as set forth in claim 3, wherein:

said spring shifting means comprises a screw rotatably mounted on said support, and threadedly engaging said spring adjacent the second end thereof, whereby axial rotation of said screw pivots said spring about the first end thereof to vary back tension.

5. A chair as set forth in claim 3, wherein:

said spring shifting means comprises a cam rotatably mounted on said support, and including a spiral cam surface operably engaging said spring adjacent the second end thereof, whereby axial rotation of said cam pivots said spring about the first end thereof to vary back tension.

6. A chair as set forth in claim 3, wherein said spring shifting means comprises:

an arm having one end thereof rotatably mounted on said support and the other end thereof pivotally connected with said spring adjacent the second end thereof; said arm having an elongate slot therein extending in a preselected direction;

a slide having a guide portion thereof slidably received in the slot of said arm;

means for translating said slide in a direction non-parallel with the preselected direction of said arm slot, whereby translation of said slide pivots said spring about the first end thereof to vary back tension.

7. A chair as set forth in claim 3, wherein:

said spring shifting means comprises a worm rotatably mounted on said support, and a gear operably connected with said spring and rotating therewith about said spring first end; said worm meshing with said gear, whereby rotation of said worm pivots said spring about the first end thereof to vary back tension.

8. A chair as set forth in claim 3, wherein:

said spring shifting means comprises means for longitudinally shifting said spring second end between an engaged position wherein said spring second end abuts the abutment surface of said back at one of said selected locations, and a disengaged position wherein said spring second end is spaced apart from the abutment surface of said back to permit free rotation of said spring about the second end thereof to vary back tension.

9. A chair as set forth in claim 3, wherein:

said spring comprises a first spring that generates a first torque which resist those forces that tilt said back rearwardly; and including a second spring having a first end thereof operably connected with said support, and a second end thereof operably connected with said back at a location offset from said tilt axis, whereby rearward tilting of said back deflects said second spring, thereby generating a second torque that resists those forces that tilt said back rearwardly; said second spring being pretensed to create a minimum amount of said second torque which biases said back into a normally, fully upright position, whereby said first and second springs combine to share the load applied to said back during tilting, with said second spring providing a minimum base torque, and said first spring providing a variable additional torque to adapt said chair for different users and various applications.

10. In a chair of the type having a support and a back which tilts about an axis with respect to said support, the improvement of an adjustable, back tension controller, comprising:

a rack supported on said back, and including a plurality of selected locations which are spaced apart preselected distances from said tilt axis;

a spring having a first end thereof pivotally connected with said support, and a second end thereof shaped to selectively engage said rack at the selected locations thereon, whereby rearward tilting of said back deflects said spring, thereby generating a torque which resiliently resists rearward tilting of said back; and means for pivoting said spring about the first end thereof to shift said spring second end between the selected locations on said back, whereby said back tension controller is easily and quickly adjusted to adapt said chair for different users and various applications.

11. A chair as set forth in claim 10, wherein:

said rack includes a plurality of grooves disposed at the selected locations, and said spring second end includes a tooth shaped for mating reception in said rack grooves to positively retain said spring in one of a plurality of different tension settings.

12. A chair as set forth in claim 11, including:

means for longitudinally shifting said tooth between an engaged position within one of said rack grooves, and a disengaged position outside of said rack grooves to permit rotation of said spring, and define at least a portion of said spring shifting means.

13. A chair as set forth in claim 12, wherein said tooth shifting means comprises:

means for connecting the one end of said spring with said support to permit limited linear translation of said spring between the engaged and disengaged positions;

means for bodily shifting said spring between the engaged and disengaged positions.

means for positively blocking said spring against said support in the engaged position, whereby rearward tilting of said back from the fully upright position further deflects said spring.

14. A chair as set forth in claim 12, including:

means for preloading said spring, whereby when said tooth is in said engaged position, rearward tilting of said back from a fully upright position is resisted by an initial torque.

15. A chair as set forth in claim 14, wherein said tooth is fixedly mounted on said spring second end, and extends longitudinally outwardly therefrom.

16. A chair as set forth in claim 15, wherein said tooth shifting means comprises:

means for connecting the one end of said spring with said support to permit limited linear translation of said spring between the engaged and disengaged positions;

means for bodily shifting said spring between the engaged and disengaged positions;

means for positively blocking said spring against said support in the engaged position, whereby rearward tilting of said back from the fully upright position further deflects said spring.

17. A chair as set forth in claim 16, wherein:

said spring comprises a compression spring.

18. A chair as set forth in claim 17, wherein said spring preloading means comprises a spring holder including:

a first member pivotally mounted on said support, and including a stop adjacent one end thereof abutting one end of said compression spring;

a second member telescopically mounted in the other end of said first spring holder member for longitudinal extension and retraction therewith, and including a stop adjacent one end thereof abutting the other end of said compression spring;

means for positively limiting relative longitudinal translation of said first and second spring holder members between a fully extended position and a fully retracted position; and wherein said compression spring is compressed between said stops in the fully extended position.

19. A chair as set forth in claim 18, wherein said spring blocking means comprises:

at least one wedge positioned between the one end of said first spring holder member and said support.

20. A chair as set forth in claim 18, wherein:

said spring holder limiting means comprises a pin fixedly mounted in said support, and extending laterally through a mating, elongated slot in said spring holder; and said spring blocking means comprises:

a pair of wedges positioned between said pin and said first named spring stop to positively transmit forces therebetween;

means for longitudinally converging and diverging said wedges to permit shifting said spring between the engaged and disengaged positions.

21. A chair as set forth in claim 20, wherein:

said rack grooves are positioned in said rack along an arc having its center disposed generally coincident with the axis about which said spring first end pivots.

22. A chair as set forth in claim 21, wherein said spring shifting means further comprises:

a first arm, having a first end thereof fixedly connected with said spring holder, and a free, second end;

a second arm, having a medial portion thereof pivotally connected with said first arm, a first end connected to at least one of said wedges, and a free, second end, whereby convergence of the free second ends of said arms longitudinally diverges said wedges to permit shifting said spring.

23. A chair as set forth in claim 22, wherein said spring shifting means further comprises:

a cam arm connected with said second arm and positioned to abut said support as the free, second ends of said arms are converged, thereby pulling said spring away from said rack toward the disengaged position.

24. A chair as set forth in claim 23, wherein said spring shifting means further comprises:

means for resiliently urging said wedges into convergence, and normally retaining said spring in the engaged position.

25. A chair as set forth in claim 24, including:

a control lever positioned on said chair at a location readily accessible by a user seated in said chair; and a remote control means having one end thereof operably connected with said first and second arms, and a second end thereof operably connected with said control lever, whereby manual manipulation of said control lever shifts said spring between the engaged and disengaged positions.

26. A chair as set forth in claim 25, including:

a control lever positioned on said chair at a location readily accessible by a user seated in said chair; and a remote control means having one end thereof operably connected with said spring, and a second end thereof operably connected with said control lever, whereby manual manipulation of said control lever, when said spring is in the disengaged position, shifts said spring between the different tension settings.

27. A chair as set forth in claim 25, including:

a control lever positioned on said chair at a location readily accessible by a user seated in said chair; and remote control means having one end thereof operably connected with said first and second arms, and said spring, and a second end thereof operably connected with said control arm, whereby manual manipulation of said control lever both shifts said spring between the engaged and disengaged positions, and when said spring is in the disengaged position, shifts said spring between the different tension settings.

28. A chair as set forth in claim 27, including:

a second spring, having a first end thereof connected with said support, and a second end thereof connected with said back at a location offset from said tilt axis, whereby rearward tilting of said back also deflects said second spring to generate additional torque, and share with said first-named spring in resisting those forces which tilt said back rearwardly.

29. A chair as set forth in claim 28, wherein:

one of said rack grooves is positioned to lie in a plane extending from said tilt axis and through the pivot axis of the first end of said first named spring, whereby when said tooth is engaged in said one groove, rearward tilting of said back is resisted substantially solely by said second spring.

30. A chair as set forth in claim 29, wherein:

said second spring is positioned on one side of said first-named spring; and including a third spring positioned on the other side of said first-named spring, and having a first end thereof connected with said support, and a second end thereof connected with said back at a location offset from said tilt axis, whereby rearward tilting of said back also deflects said third spring to generate additional torque and share with said first and second springs in resisting those forces which tilt said back rearwardly.

31. A chair as set forth in claim 30, wherein:

said second and third springs are preloaded to provide a minimum amount of torque to said back in the fully upright position, such that a user may adjust said first-named spring from a comfortable, seated position in said chair to achieve a desired pretension and tilt rate for said back.

32. A chair as set forth in claim 10, including:

means for preloading said spring, whereby rearward tilting of said back from a fully upright position is resisted by an initial torque.

33. A chair as set forth in claim 10, wherein:

said spring comprises a compression spring.

34. A chair as set forth in claim 10, wherein:

said selected locations on rack are positioned an arc having its center disposed generally coincident with the axis about which said spring first end pivots.

35. A chair as set forth in claim 10, including:

a control lever positioned on said chair at a location readily accessible by a user seated in said chair; and a remote control means having one end thereof operably connected with said spring pivoting means, and a second end thereof operably connected with said control lever, whereby manual manipulation of said control lever shifts said spring between the selected locations on said back.

36. A chair as set forth in claim 10, including:

a second spring, having a first end thereof connected with said support, and a second end thereof connected with said back at a location offset from said tilt axis, whereby rearward tilting of said back also deflects said second spring to generate additional torque, and shaire with said first-named spring in resisting those forces which tilt said back rearwardly.

37. A chair as set forth in claim 36, wherein:

one of said selected positions is positioned to lie in a plane extending from said tilt axis and through the pivot axis of the first end of said first named spring, whereby when said spring second end is disposed at said one of said selected positions, rearward tilting of said back is resisted substantially solely by said second spring.

38. A chair as set forth in claim 36, wherein:

said second spring is preloaded to provide a minimum amount of torque to said back in the fully upright position, such that a user may adjust said first-named spring from a comfortable, seated position in said chair to achieve a desired pretension and tilt rate for said back.

39. In seating of the type having a first portion and a second portion which articulates about an axis with respect to said first portion, the improvement of an adjustable tension controller, comprising:

an abutment surface disposed on one of said first and second portions, and including a plurality of selected locations which are spaced apart different distances from said axis;

a spring having a first end thereof operably connected with the other of said first and second portions, and a second end thereof operably engaging the abutment surface of the one of said first and second portions, whereby articulation of one of said first and second portions with respect to the other of said first and second portions deflects said spring, thereby resiliently resisting said articulation; and means for shifting said spring second end between said selected locations, whereby said tension controller is easily and quickly adjusted to adapt said seating for different users and various applications.

40. A seating article as set forth in claim 39, including:

means for preloading said spring, whereby rearward tilting of said back from a fully upright position is resisted by an initial torque.

41. A seating article as set forth in claim 39, wherein:

said spring shifting means comprises means for longitudinally shifting and spring second end between an engaged position wherein said spring second end abuts said back at one of said selected locations, and a disengaged position wherein said spring second end is spaced apart from said back to permit free rotation of said spring about the second end thereof to vary back tension.

42. A seating article as set forth in claim 39, wherein:

said spring comprises a first spring that generates a first torque which resist those forces that tilt said back rearwardly; and including a second spring having a first end thereof operably connected with said support, and a second end thereof operably connected with said back at a location offset form said tilt axis, whereby rearward tilting of said back deflects said second spring, thereby generating a second torque that resists those forces that tilt said back rearwardly; said second spring being pretensed to create a minimum amount of said second torque which biases said back into a normally, fully upright position, whereby said first and second springs combine to share the load applied to said back during tilting, with said second spring providing a minimum base torque, and said first spring providing a variable additional torque to adapt said chair for different users and various applications.

43. In a chair of the type having a support and a back which tilts about an axis with respect to said support, the improvement of an adjustable, back tension controller, comprising:

a spring having a first end thereof connected with said support, and a second end thereof operably engaging a portion of said back at selected locations thereon which are spaced apart from said tilt axis, whereby rearward tilting of said back deflects said spring, thereby generating a torque which resiliently resists rearward tilting of said back;

means for shifting said spring second end between the selected locations on said back, whereby said back tension controller is easily and quickly adjusted to adapt said chair for different users and various applications; and means for preloading said spring, whereby rearward tilting of said back from a fully upright position is resisted by an initial torque.

44. A chair as set forth in claim 43, wherein:

said spring shifting means comprises means for longitudinally shifting said spring second end between an engaged position wherein said spring second end abuts said back at one of said selected locations, and a disengaged position wherein said spring second end is spaced apart from said back to permit free rotation of said spring about the second end thereof to vary back tension.

45. A chair as set forth in claim 43, wherein:

said spring comprises a first spring that generates a first torque which resist those forces that tilt said back rearwardly; and including a second spring having a first end thereof operably connected with said support, and a second end thereof operably connected with said back at a location offset from said tilt axis, whereby rearward tilting of said back deflects said second spring, thereby generating a second torque that resists those forces that tilt said back rearwardly; said second spring being pretensed to create a minimum amount of said second torque which biases said back into a normally, fully upright position, whereby said first and second springs combine to share the load applied to said back during tilting, with said second spring providing a minimum base torque, and said first spring providing a variable additional torque to adapt said chair for different users and various applications.

46. In seating of the type having a first portion and a second portion which articulates about an axis with respect to said first portion, the improvement of an adjustable tension controller, comprising:

a spring having a first end thereof operably connected with one of said first and second portions, and a second end thereof operably engaging the other of said first and second portions at selected locations thereon which are spaced apart form said axis, whereby articulation of one of said first and second portions with respect to the other of said first and second portions deflects said spring, thereby resiliently resisting said articulation; and means for shifting said spring second end between said selected locations, whereby said tension controller is easily and quickly adjusted to adapt said seating for different users and various applications;

means for preloading said spring, whereby articulation of one of said first and second portions with respect to the other of said first and second portions is resisted by an initial torque.

47. A seating article as set forth in claim 46, wherein:

said spring shifting means comprises means for longitudinally shifting said spring second end between an engaged position wherein said spring second end abuts said other of said first and second portions at one of said selected locations, and a disengaged position wherein said spring second end is spaced apart from said other of said first and second portions to permit free rotation of said spring about the second end thereof to vary back tension.

48. A seating article as set forth in claim 46, wherein:

said spring comprises a first spring that generates a first torque which resist those forces that mutually articulate said first and second seating portions; and including a second spring having a first end thereof operably connected with one of said first and second portions, and a second end thereof operably connected with the other of said first and second portions at a location offset from said tilt axis, whereby articulation of one of said first and second portions with respect to the other of said first and second portions deflects said second spring, thereby generating a second torque; said second spring being pretensed to create a minimum amount of said second torque, whereby said first and second springs combine to share the load applied to said seating, with said second spring providing a minimum base torque, and said first spring providing a variable additional torque to adapt said seating for different users and various applications.

* * * * *

UNITED STATES PATENT AND TRADEMARK OFFICE

CERTIFICATE OF CORRECTION

PATENT NO. : 5,026,117

DATED : 06/25/91

INVENTOR(S) : Frederick S. Faiks

It is certified that error appears in the above-identified patent and that said Letters Patent is hereby corrected as shown below:

Column 19, line 34:
"shaire" should be --share--;
Column 3, line 46:
after "controller," insert --with--;
Column 4, line 13:
after "controller" insert --,--;
Column 4, line 27:
after "tilting" delete --,--;
Column 14, line 18:
"Gear Shifter Controller" should be --GEAR SHIFTER CONTROLLER--;
Column 14, line 61:
"form" should be --from--;
Column 20, line 11:
"and" should be --said--;
Column 20, line 25:
"form" should be --from--;
Column 21, line 28:
"form" should be --from--.

Signed and Sealed this

Sixteenth Day of February, 1993

*Attest:*

STEPHEN G. KUNIN

*Attesting Officer*

*Acting Commissioner of Patents and Trademarks*